US007647803B2

(12) United States Patent
Bodnar

(10) Patent No.: US 7,647,803 B2
(45) Date of Patent: Jan. 19, 2010

(54) ROTARY APPARATUS WITH MULTIPLE GUIDES AND METHOD OF FORMING

(76) Inventor: Ernest R. Bodnar, 2 Danrose Crescent, Toronto, Ontario (CA) M3B 3N5

( * ) Notice: Subject to any disclaimer, the term of this patent is extended or adjusted under 35 U.S.C. 154(b) by 815 days.

(21) Appl. No.: 10/931,042

(22) Filed: Sep. 1, 2004

(65) Prior Publication Data

US 2007/0051151 A1 Mar. 8, 2007

(51) Int. Cl.
*B21B 21/00* (2006.01)
*B23D 25/02* (2006.01)
*B23D 25/12* (2006.01)

(52) U.S. Cl. ..... 72/191; 72/190; 83/324; 83/337; 83/343

(58) Field of Classification Search ..... 72/186, 72/190, 191, 194–197, 452.4–452.6; 83/311, 83/324, 331, 337, 343
See application file for complete search history.

(56) References Cited

U.S. PATENT DOCUMENTS 5,040,397 A * 8/1991 Bodnar ..... 72/190

* cited by examiner

*Primary Examiner*—Dana Ross
*Assistant Examiner*—Teresa M Bonk

(57) ABSTRACT

A rotary forming apparatus of the type having a pair of central rotors, and one or more die carriers swingably mounted on the rotors, for repeatedly forming a sheet metal work piece moving along a linear path, rotor bearing supports for supporting the rotors at least at one end thereof, die carrier guides on the die carriers at an end thereof adjacent to the rotor bearing supports, and, at least two cam plates adjacent to each the rotor bearing support, for guiding the die carriers guides.

14 Claims, 23 Drawing Sheets

| Angle | Actual Die Distance to CenterLine | Pace |
|---|---|---|
| 0 | 0 | 0.266 |
| 3 | 0.266 | 0.266 |
| 6 | 0.532 | 0.263 |
| 9 | 0.795 | 0.262 |
| 12 | 1.057 | 0.259 |
| 15 | 1.316 | 0.255 |
| 18 | 1.571 | 0.251 |
| 21 | 1.822 | 0.246 |
| 24 | 2.068 | 0.240 |
| 27 | 2.308 | 0.000 |

FIG. 24

ROTARY APPARATUS WITH MULTIPLE GUIDES AND METHOD OF FORMING

FIELD OF THE INVENTION

The invention relates to the forming of sheet metal using rotary forming apparatus with dies mounted on the rotary apparatus for rotation and sequential contact with the sheet metal and to such an apparatus having multiple guides for the rotary apparatus and to a method of forming sheet metal.

BACKGROUND OF THE INVENTION

Conventional forming of sheet metal, particularly when blanking out openings, and forming shapes or formations around the openings, has for many years been carried out using upper and lower dies in what is essentially a stationary press. The sheet metal is placed between the two dies, the dies close and open and the metal is formed. Major improvements have been made in this process, by rotary forming systems. In these systems the sheet metal is fed from a roll and moves continuously between a pair of upper and lower rolls. On these rolls there are pairs of dies. As the rolls rotate, the pairs of dies meet, close and open, and form the sheet metal. These systems in theory have major advantages over stationary press operations. The sheet metal can be fed continuously, in some cases at considerable line speeds in excess of 200 feet per minute or more. The sheet metal once formed can be cut off into suitable work pieces, and the entire operation can be carried out automatically at high speed. In fact, however it has been found that there are numerous problems in these proposals. Rotary machines of this type have been proposed for many years. Some such machines have had a limited degree of success. In particular, if all that is required is to form a series of depressions or shapes in the sheet metal, such rotary machines may be relatively satisfactory. However, when it is desired to blank out openings in the sheet metal and then form shapes or bends around the sheet metal at the edges of the openings the problems become much more complex. The problems are further compounded by the fact that one of the major uses for such a sheet metal product, if it could be produced satisfactorily, would be as a replacement for wooden studs used in construction. Such metal studs must necessarily be formed with lengthwise bends or shapes, so that they may carry loads. Sheet metal studs of this type with a simple c-section have been made for many years, since at least the 1930's. However, such sheet metal studs also have disadvantages in that they act as efficient pathways for the transfer of heat. As a result, buildings made with such sheet metal studs suffer from considerable heat losses, greatly in excess of that experienced with wooden studs. To overcome this problem, various proposals have been made for forming openings in the sheet metal studs. One such form of proposal is shown in U.S. Pat. No. 2,088,781. Another proposal is shown in Canadian Patent 1192015. In both of these proposals, and many other patents of similar design, the design is based on a sheet metal stud having angled formations along either side edge which are continuous, and having a series of generally triangular or trapezoidal openings formed in the web between the edges. The triangular openings are alternately reversed in direction, so as to produce struts extending between the two edges of the stud which effectively form a zigzag up the length of the stud. The forming of the longitudinal edge formations is relatively easy to carry out using conventional roll forming dies of a type which are well in the art and require no description. However the forming of the openings, using rotary machines presents a series of complex problems. The openings must be formed by pairs of dies which alternate from one pair of dies to the other in the orientation of the opening. In addition, around each of the openings there are formed flanges to increase the strength of the stud and to increase the strength of the diagonal zigzag struts. One of the problems in designing such machines is that the dies are travelling around a circular path. The sheet metal is travelling on a linear path. The dies will contact the sheet metal just before the dies close and will remain in contact with the sheet metal until just after the dies open. The dies travel along an arcuate path. During this brief time span, there is a slight change in linear speed between the linear speed of the dies themselves and the linear speed of the metal. Just prior to closing and just after opening, the dies will be moving at a slightly slower linear speed than the sheet metal, and only when fully closed will the dies be moving momentarily at the same speed as the sheet metal. While this may not seem a significant factor, it causes distortion of the sheet metal especially when the line speeds are increased. Another problem is in controlling the orientations of the pairs of dies prior to closing and just after opening. It is apparent that the dies, which are similar to dies used in stationary stamping presses, must lie in predetermined planes in order to form the work piece. In a rotary apparatus the planes of each of the dies in any one pair must be brought parallel to one another just prior to closing on the sheet metal and must remain parallel through closing and after opening, for a certain length of time. In order to achieve this the dies themselves are mounted on die carriers. The die carriers are mounted on semi rotary bearings. These semi rotary bearings are carried on a central rotor press shaft. The die carriers are capable of swinging relative to the central shaft. In this way, the die carriers, and their dies can be swung into the necessary parallel orientation just prior to closing, and remain in that orientation until just after opening.

The problem that exists in the design of such a rotary machine is in guiding the die carriers, so that they swing into the appropriate parallel planes and remain there during the operative arcuate part of the cycle. Various different forms of guides have been designed for use in different machines, some of which are described above in the Patents referred to. These guide rollers are cam followers, which are mounted on the semi rotary die carriers. Cam plates are secured on one or both sides of the rotor press shaft. The guide rollers rotate around the cams as the rotor shaft rotates. The cams have a predetermined profile such that they control the orientation of the semi rotary die carriers as they travel around the rotation of the rotor shaft. The location of the two guide rollers on each die carrier presents problems. The guide rollers should preferably be located with at least one on the leading edge and one on the trailing edge of the die carrier, so as to provide a sufficient degree of control for levelling the die carriers as they close and open on the sheet metal. This however in turn presents problems, since the profile of the cams on which those two guide rollers must necessarily ride, will be different from each other. The two guide rollers must necessarily follow two different guide paths as they rotate. One way of achieving this result was to provide a leading guide roller at one end of the die carrier and a trailing guide roller at the other end of the die carrier. A first cam plate was mounted adjacent to one end of the rotor shaft and a second cam plate was located adjacent the other end of the rotor shaft. A problem which had also been encountered was that when the guide rollers were designed to ride in a groove in a cam plate, it was found that with the guide roller rotating in contact with one surface of the groove, this necessarily involved the guide roller rotating in a reverse direction against the opposite surface of the groove. One solution to this problem was to enlarge the groove so as to overcome the problems of rapid wear. This resulted in a less than perfect guidance around the arc of rotation which meant that the dies were not always guided into the exactly parallel planes which were required. One proposal for a solution was the provision of guide rollers in pairs on the same axles. Even with this improvement however it has been found that with heavier die carriers and dies, and when operating at higher rotational speeds, there was still some slack in the guidance system, and portions of the guidance system were unable to provide adequate control for the die carriers. It appears from further development that guidance rollers should be provided along both the leading and the trailing edges of the die carriers, so as to permit heavier capacity dies to be used, and higher operating speeds to be achieved. However, for various reasons it has been found difficult to provide guidance by means of guide rollers on the leading edge of the die carriers, and also along the trailing edge of the die carriers, without providing some form of guide cams adjacent to each end of the central rotor shaft. The leading and trailing guide rollers must follow different patterns.

It is also desirable to provide controls for the fine adjustments of linear speed which are required in order to match the linear speeds of the die carriers with the linear speed of the sheet metal. The speed adjustments required to match the linear speeds of the die carriers with the linear speed of the sheet metal in the past have been achieved by dies and die carriers which incorporated slides and springs which simply enabled the dies themselves to speed up when they contacted the sheet metal and again as the dies opened. This form of speed control was achieved simply by the dies contacting the sheet metal and being moved against springs.

Another and entirely different set of requirements arises when it is realized that such a rotary machine will normally involve the use of shaft support plates and shaft support bearings at each end of the central rotor shaft. This in turn means that each new piece of sheet metal must be introduced between the upper and lower rotor shafts in a somewhat intricate threading operation. In many situations it has been found desirable to provide a rotary apparatus of this kind and to provide roller dies to compliment the rotary apparatus which are supported on bearings stands only at one end of each of the shafts, leaving the opposite end of each shaft unsupported. This type of "open sided" rotary apparatus has great advantages over the more conventional design, since it enables a much greater flexibility in the rearrangement of dies, and the retooling of the apparatus, and the threading of new sheet metal work pieces and the like, all of which is made much easier having the so called "open ended" rotary apparatus which is accessible from one end without the use of bearings supports previously used at both ends of each shaft.

BRIEF SUMMARY OF THE INVENTION

With a view to overcoming at least some of the various problems outlined above the invention comprises a rotary forming apparatus of the type having a pair of central rotors, and one or more die carriers swingably mounted on each of the rotors, for repeatedly forming a sheet metal work piece moving along a linear path, rotor supports for supporting the rotors at least at one end thereof, dies carrier guides on the die carriers at an end thereof adjacent to said rotor supports, and at least two cam plates adjacent to each said rotor support, for guiding said die carrier guides.

The invention further provides such an apparatus wherein there are two such rotor supports, one at each end of rotors and wherein said cam plates are mounted on one of said supports, the other of said supports being free of such cam plates.

The invention further comprises such an apparatus in which the cam plates comprise a first integral one piece cam plate, and a second cam plate of at least two part construction, said second cam plate defining a gate, through which said die carrier guides may pass.

The invention further comprises such an apparatus wherein the rotors are driven by a variable speed motor, and including control means for slowing and speeding up said motor intermittently, in timed relation to the movement of the sheet metal work piece.

The invention further comprises such an apparatus wherein the motor control is operable to speed up the motor at a first predetermined position of said die carriers, and to gradually slow down the motor progressively towards a second predetermined position of said die carriers, and thereafter gradually speed up the motor towards a third predetermined position of said die carriers.

The invention further comprises such an apparatus wherein there are two such rotors each rotor defining a first end and second end, and a rotor support supporting the first end of each said rotor, the second end of each rotor being supported by two separate supports, and the two rotors being mounted for rotation in opposite directions to one another, for engaging a sheet metal work piece passing there between.

The invention further comprises such an apparatus wherein there are a plurality of die carriers and a plurality of such rotors.

The invention further comprises such an apparatus wherein there is a guide bridge movably mounted on said second guide cams and swingable to allow contact of a said guide roller thereon at one position in the cycle of rotation The invention further comprises a method of forming a sheet metal work piece. The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

FIG. 24 is a graph showing the variation in rotational speed before, during, and after contact, to the point of separation of the dies from the sheet metal;

DESCRIPTION OF A SPECIFIC EMBODIMENT

Figure 1:
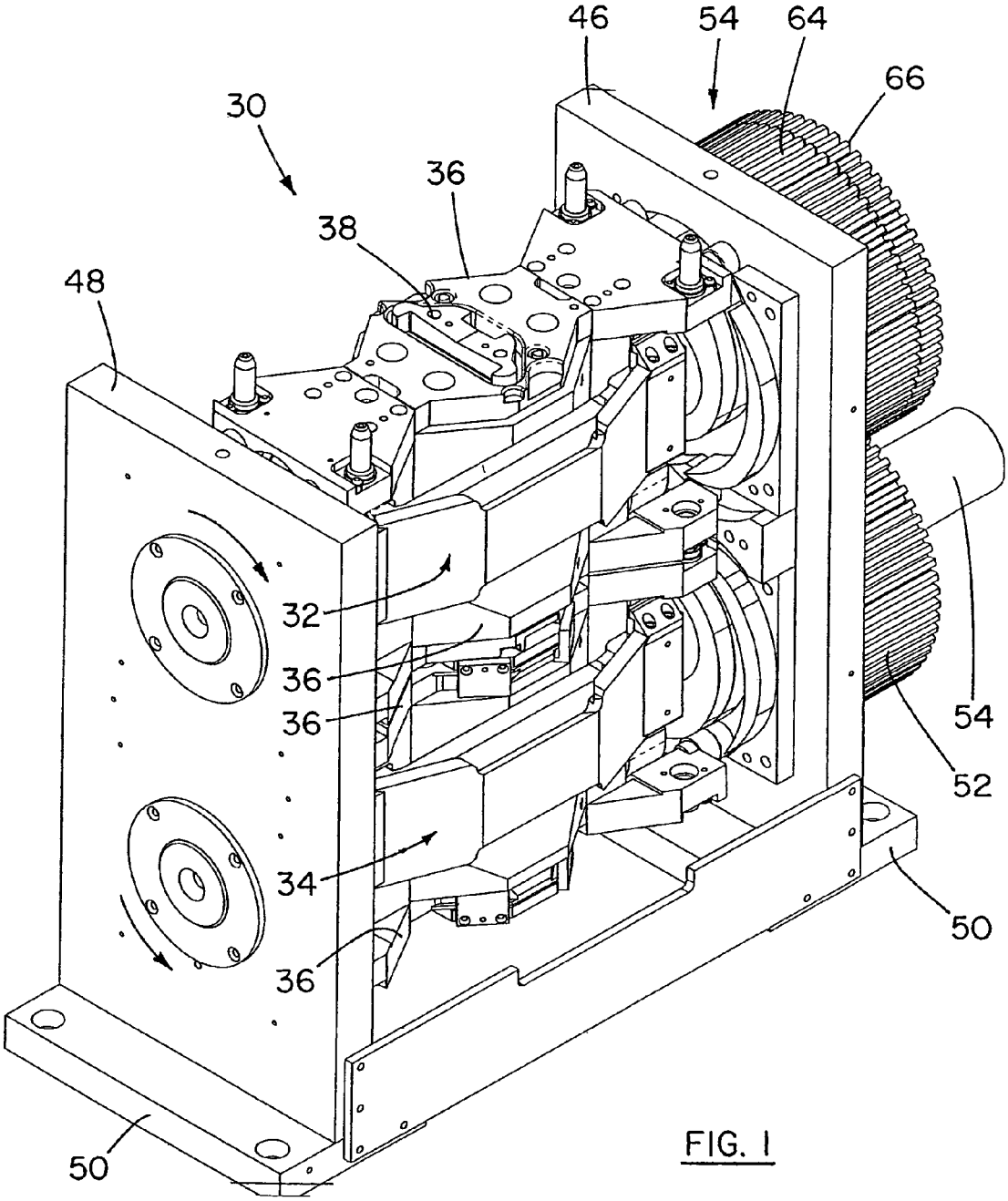
FIG. 1 is a perspective illustration of a rotary apparatus illustrating the invention.

As already explained above, the invention relates to a rotary apparatus for the rotary forming of various formations and openings in a sheet metal work piece. Such a sheet metal work piece is usually though not invariably roll fed from a large roll of sheet metal, and will move continuously through the rotary apparatus with formations being formed while the sheet metal is moving through the rotary apparatus. Usually although not invariably other formations will be formed in the sheet metal work piece progressively after it passes through the rotary apparatus, although in fact in some cases such formations can be formed before it passes through the rotary apparatus. Such formations are usually longitudinal bends, angles, flanges and the like which are formed by conventional sheet metal rolling dies. Such roller die forming has been known for many years and requires no description for those skilled in this art. In addition to the steps the sheet metal work piece will be cut into lengths suitable for its intended use. Thus, for example, where the intended use is as a metal stud for use in construction, the work pieces will be cut to the specific lengths required for the job for which it is intended. The cut to length of the metal work pieces is also carried out by various different methods such are well known in this art and require no special description. Some such cut length operations are cut by means of what are known as flying dies or sheers. Other cut length operations may be performed by a rotary cut length apparatus, or a flying die shear or any other suitable system The requirements of the cut length function are of some significance in relation to the present invention. In the particular case of metal studs in construction, the engineer or building designer may specify lengths of studs of various different parts of the building, or different structures in a complex. It is desirable from every point of view that such cut length operations shall be carried out precisely to exactly the lengths required. It is also necessary that when cutting such a work piece to length, that the location of the cut be positioned at a point where it will not intersect or interfere with formations formed in the rotary apparatus.

For example, if openings are being blanked out through a metal stud work piece, then it will be important that the cut length function be carried out between two such openings, and that if the cut does not intersect an opening. In order to achieve this the present invention provides in a manner to describe below a means of positioning the openings, and a means of temporarily skipping an opening if desired so as to leave a greater length of sheet metal, across which the cut may be made. These types of problems have been discussed in earlier patents and again unknown to persons skilled in the art. They are mentioned here simply because the present invention provides in particular, the advantageous manner in a way of providing for both the speed control of the dies as they contact the sheet metal, and also the positioning of gaps between openings to provide for cut to lengths functions, in a manner which is totally unlike the prior art.

For the purpose of explanation only a typical metal work piece is shown in FIGS. (3) and (4). The work piece is initially formed from a flat sheet metal panel, usually a panel extending from a coil of such flat sheet metal strips, the coils on the flat panel be omitted from these illustrations for the sake of clarity.

The work piece (W) has a central web (10), and two side edge bends (12) and (14). The central web (10) is formed with a series of openings (16). These openings, in this case, are of generally triangular shape and the orientation of the triangle alternates along the length of the web. In this way, struts (18) of sheet metal are defined between the adjacent openings (26). These struts (18) form a generally zigzag or diagonal shape along the length of the work piece (W). Edge flanges (20) are formed around the openings (16), in a manner to be described below.

The longitudinal side edge bends (12) and (14) are formed lengthwise continuously along the length of the work piece (W). One such bend may be sufficient or in other cases, there may be two or three such bends to provide greater strength or for various different applications. In some cases one of the side edges may be bent outwardly to form a hook (22) as shown in phantom. Such a hook (22) is used in the formation of composite concrete and stud building panels.

Typical embedment flanges are shown in U.S. Pat. No. 4,602,467. This patent relates to conventional C-section studs.

As is well known in the art such embedment formations are used when forming thin shell concrete panels to enclose a building, the studs typically being the work pieces (W) typically being embedded at spaced intervals for example 16" or two feet apart along the length of a panel, and typically upper and lower work pieces are also associated from a rectangular grid of such reinforcing work pieces. This enables the production of thin shell reinforced concrete panel having great strength and substantially reduced material and weight as compared with conventional concrete slab wall construction.

Work pieces (W), known as metal studs, have been used for some time and are shown in a variety of patterns, and embedment studs used for reinforcing concrete panels have been shown in patents to U.S. Pat. Nos. 2,088,781 and 2,167,666.

As already explained above, the rotary apparatus and method the subject of this invention are used to produce a variety of metal work pieces. One particular example of metal work piece is a stud of this general type many different products may be produced, however. The production speed in high, the accuracy of formation is excellent, and the flexibility to produce such work piece of varying widths and varying lengths and with varying formations is also greatly facilitated.

Referring now to FIGS. (1) and (2), it will be seen that these Figures illustrate in general a rotary apparatus (30). The rotary apparatus (30) comprises upper and lower main rotor assemblies (32) and (34). Each rotar has two die carriers (36) in this embodiment. Each die carrier (36) supports a die (38). Dies (38) are similar in most respects to conventional male and female dies used in stationary presses i.e. presses which reciprocate vertically but do not rotate.

Each of the central rotors (32) and (34) in this embodiment, comprises a relatively slender central shaft portion (40), and two massive end bearing portions (42). Each of the end bearing portions (42) is mounted in a respective bearing systems (44), and the bearing systems (44) are mounted in end plates (46) and (48). End plates (46) and (48) will typically be mounted on bases (50) so that they may be placed in position in a production line. The upper and lower rotors (32) and (34) are coupled together by means of a lower drive gear (52) mounted on an end wise extension (54) of lower rotor end shaft (42), and an upper gear assembly (56) mounted on an end wise extension (58) of upper rotor end shaft (42). The lower rotor end shaft extension (54) is adapted to be connected to any suitable prime mover (60) and gear box. Typically, the prime mover in this case will be a direct current electric motor, shown schematically in FIG. 26. The motor (60) will be of the type having a speed control (62) so that its rotational speed may be precisely controlled and varied for reasons to be described below.

Speed control (62) in turn is controlled by a CPU. The upper gear assembly (56) comprises a main gear portion (64) and an outer back lash compensator gear (66). The back lash compensator gear (66) may be adjustably rotated relative to the main gear portion (64) and fastened so as to eliminate any back lash between the upper gear assembly (56) and the lower drive gear (52). Each of the four end shaft portions (42) is formed in essentially the same manner as shown in FIG. (2), apart from the shaft extensions.

Figure 5:
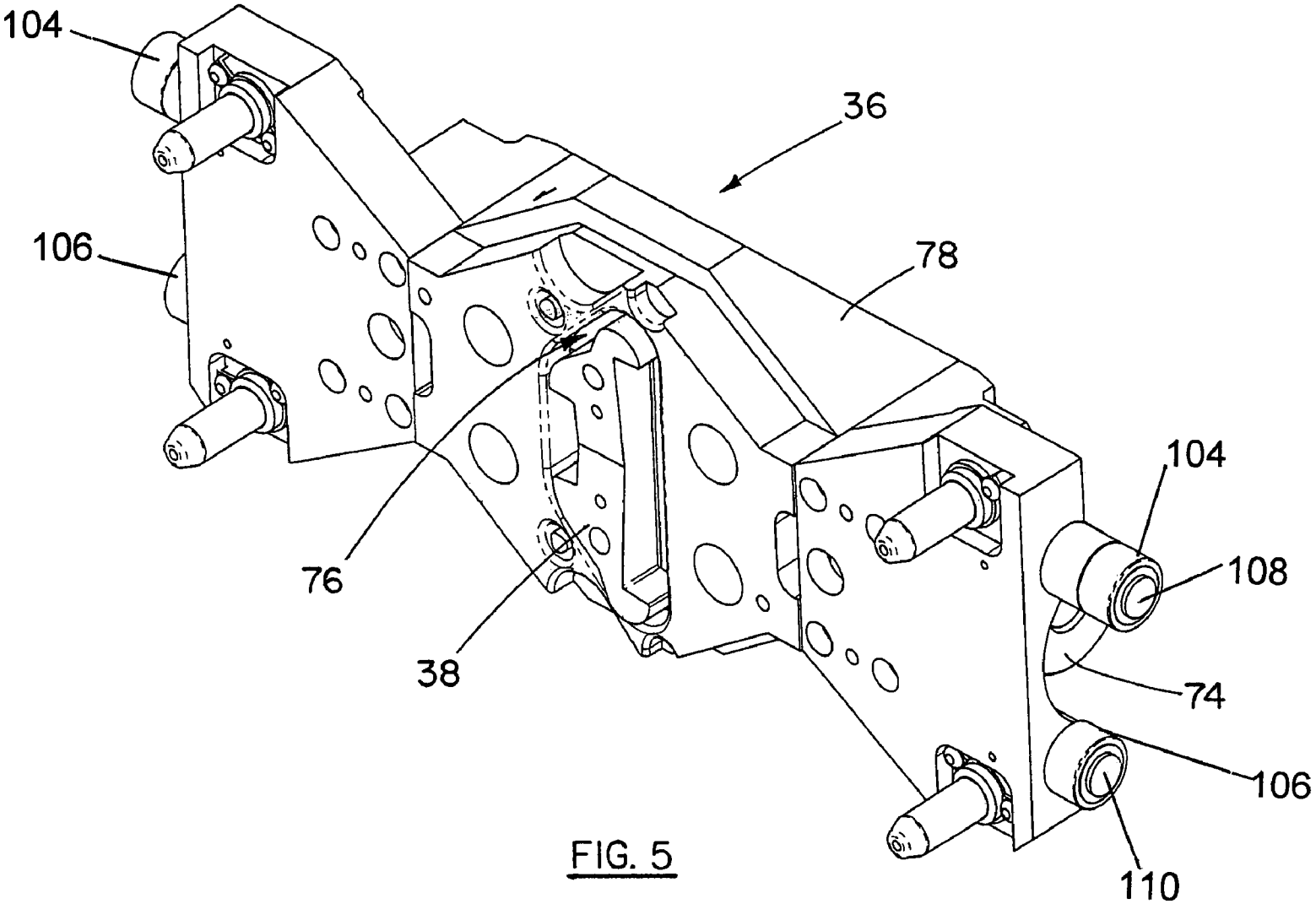
FIG. 5 is a perspective illustration of a die carrier, showing a die mounted therein, in isolation from the rotary apparatus.
Figure 6:
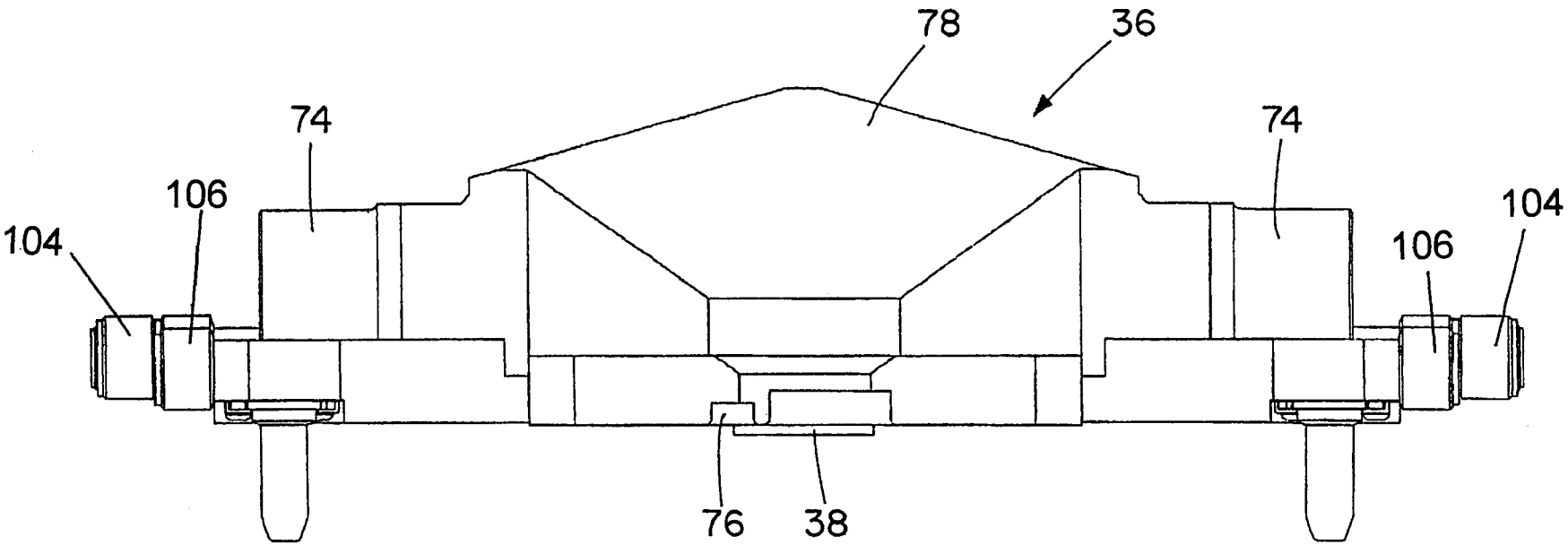
FIG. 6 is a side elevation of a die carrier.
Figure 7:
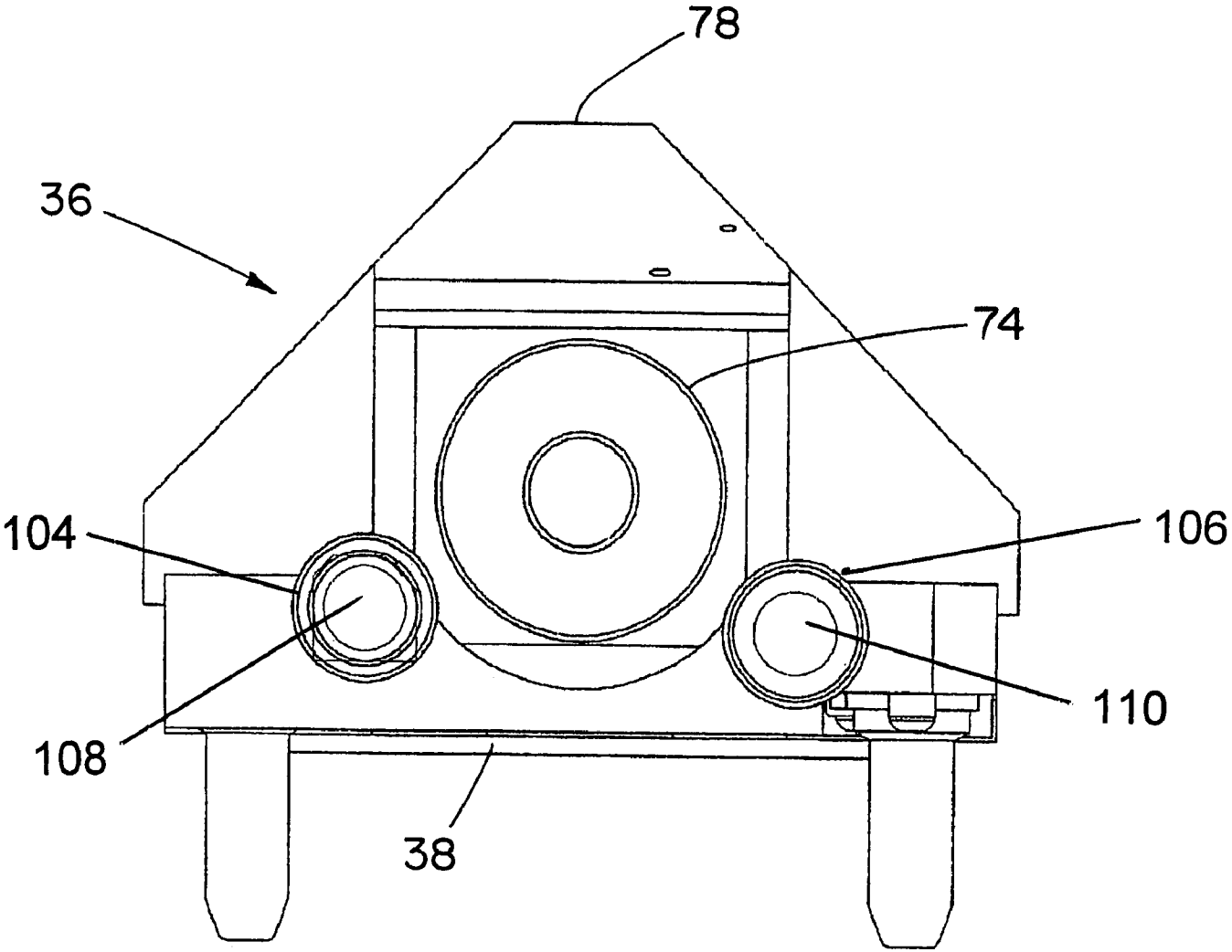
FIG. 7 is an end view of one end of a die carrier.
Figure 8:
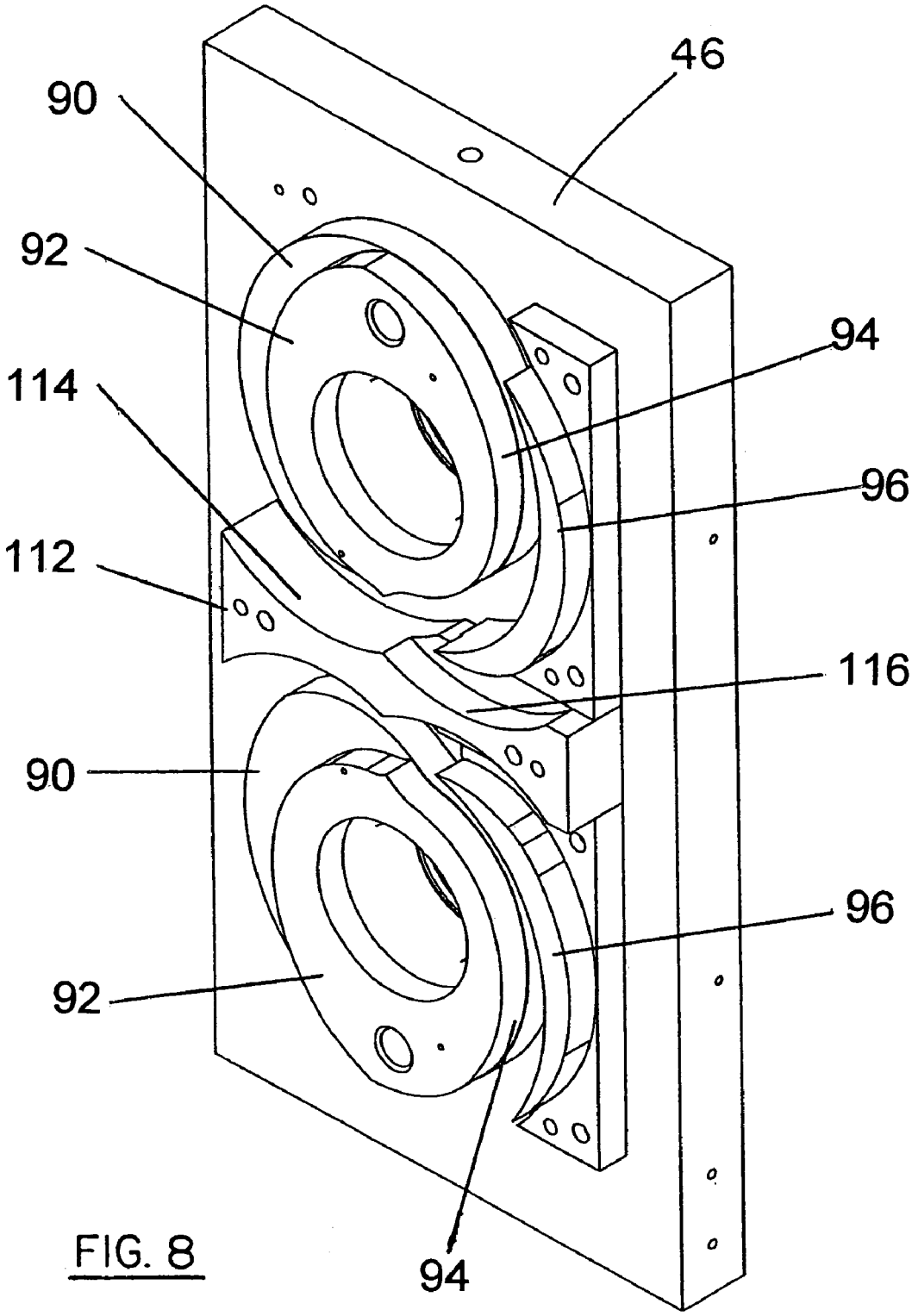
FIG. 8 is a perspective illustration of the rotor support plate and cams on the right hand end of FIG. 1.
Figure 9:
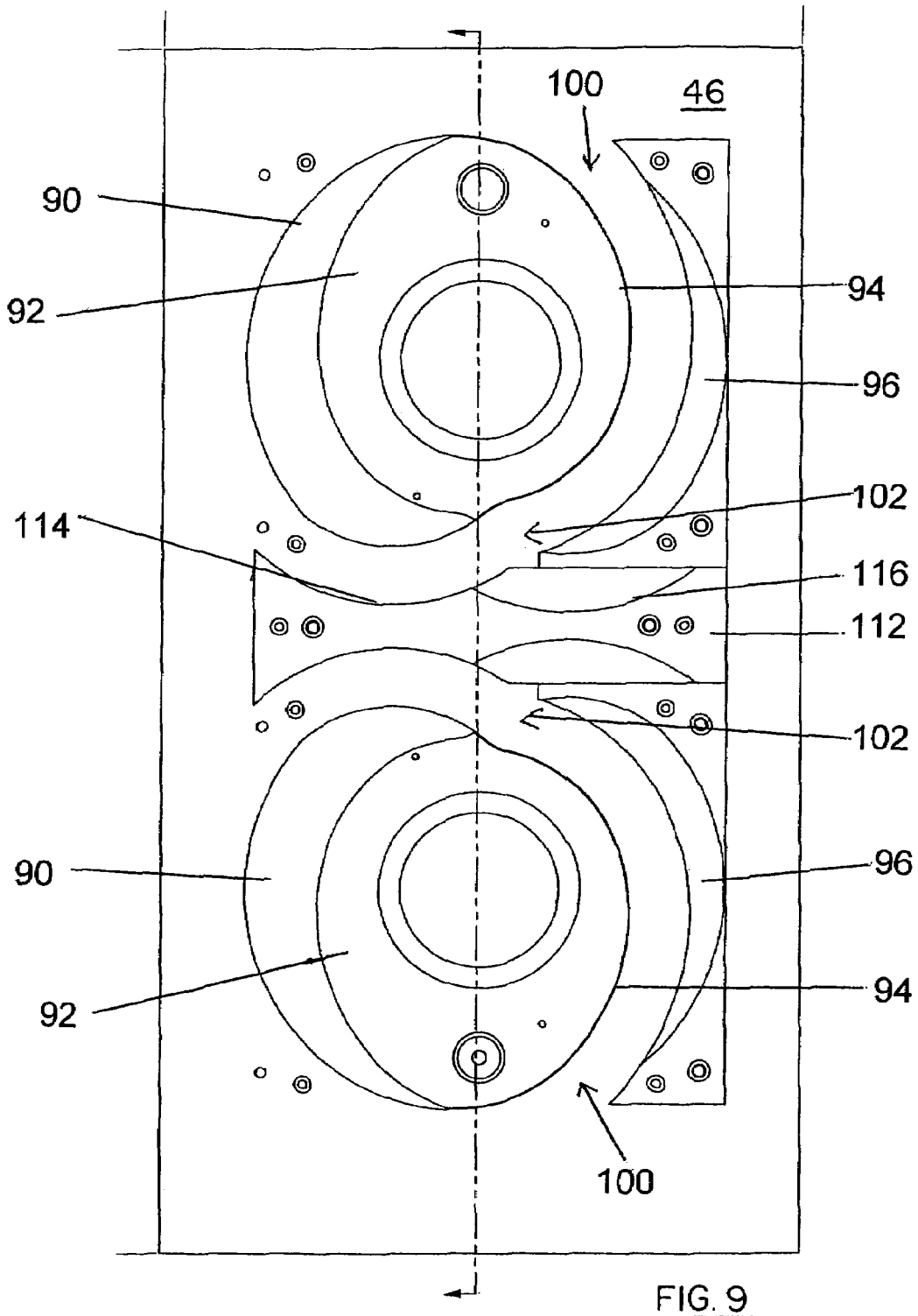
FIG. 9 is an elevational view of the rotor support of the FIG. 8.
Figure 10:
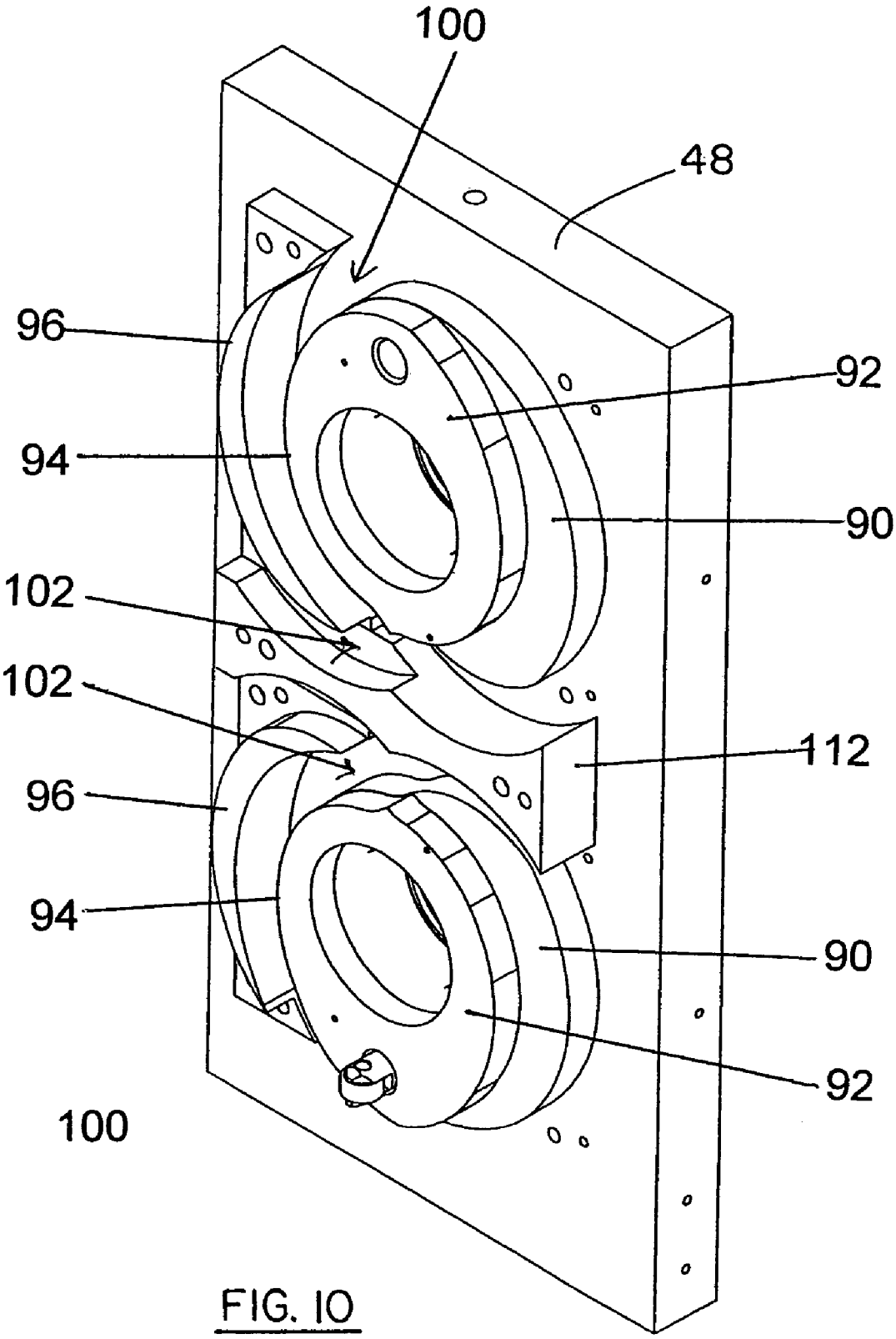
FIG. 10 is a perspective illustration of the left hand rotor support plate of the apparatus of FIG. 1.
Figure 11:
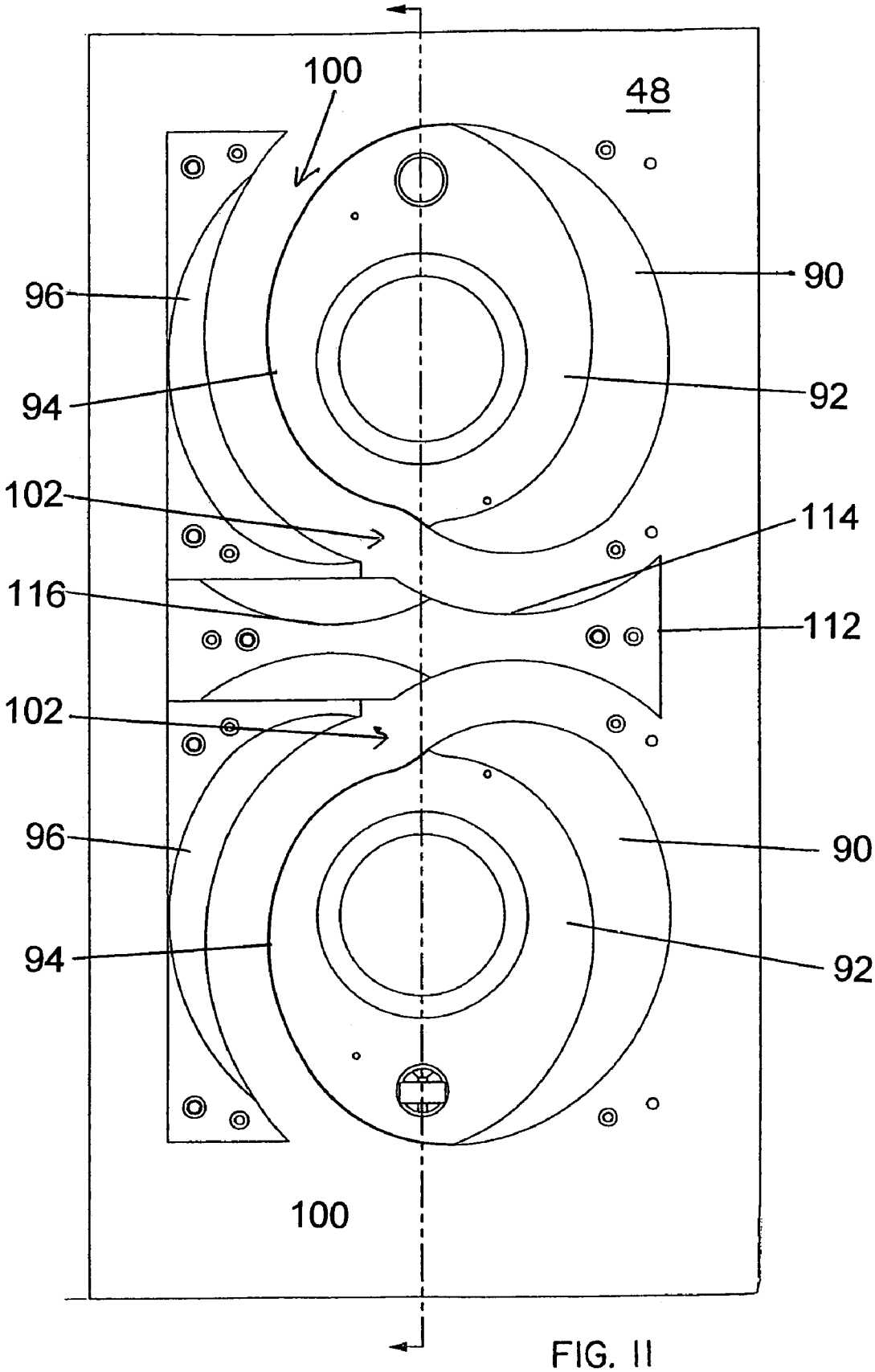
FIG. 11 is an elevational view of the bearing support plate of FIG. 10.
Figure 12:
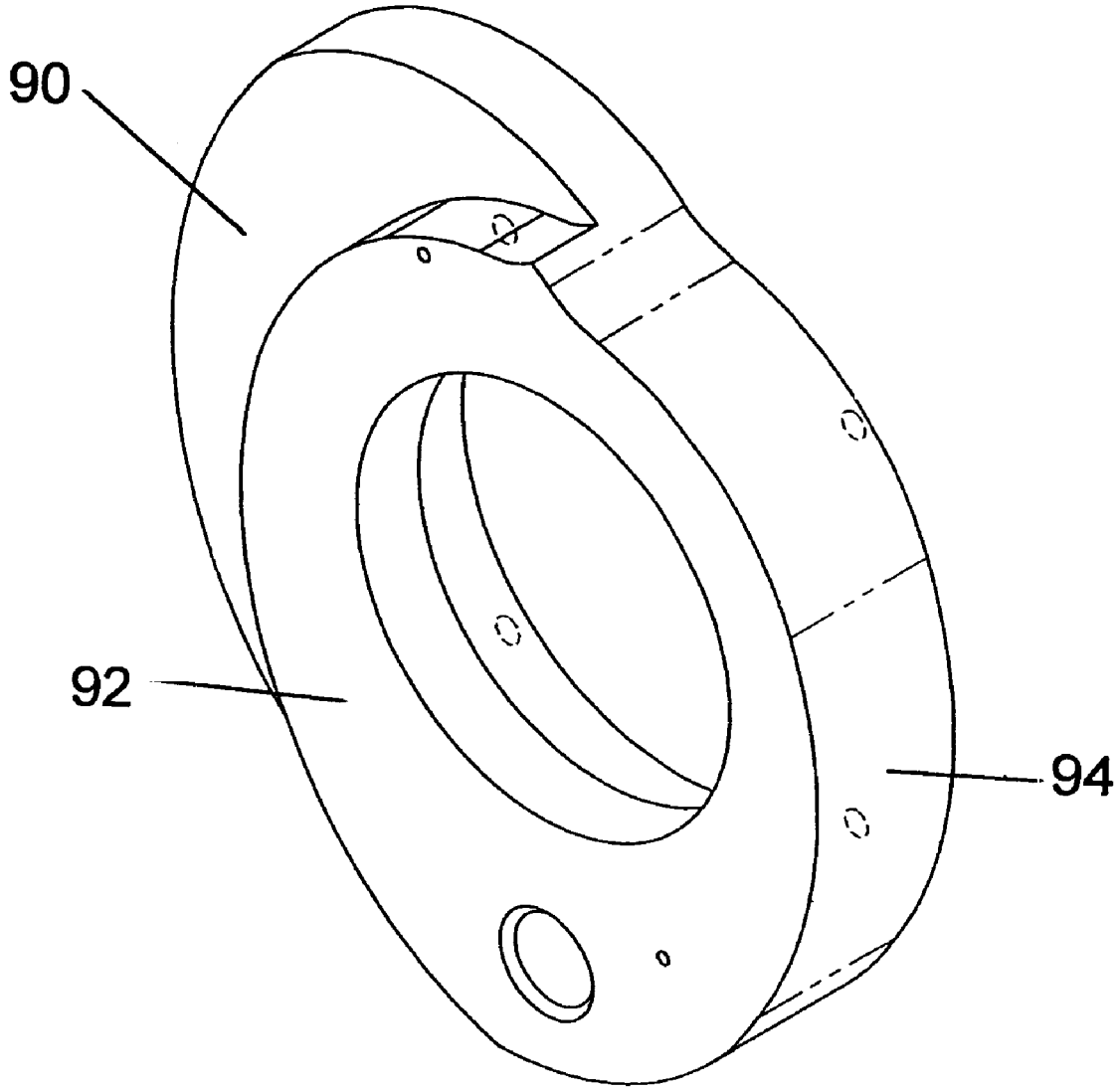
FIG. 12 is a perspective illustration of the first and second cam plate portions.
Figure 13:
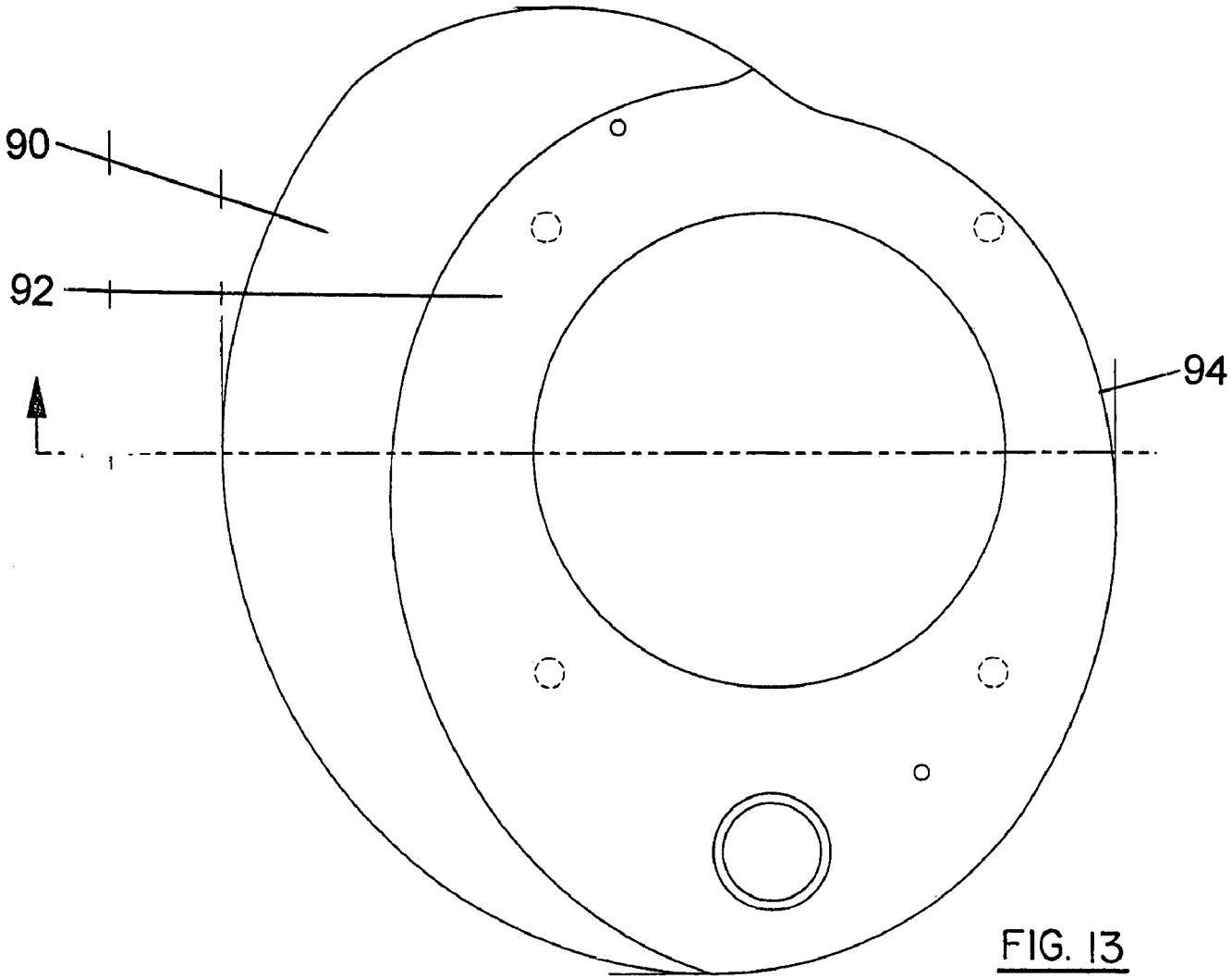
FIG. 13 is an elevational view of the cam plate portions of FIG. 12.

Each of the end shaft portions (42) is provided with two bearing recesses (68), spaced apart angularly around the axis of each rotor by 180°. Within each bearing recess (68) there is a bearing or bushing (70), which is held in position by a suitable cap. Each of the die carriers (36) in FIGS. 5, 6 and 7 is provided with an end stub shaft (74), at each end thereof. The end stub shafts (74) are received in the bearings (68) in the bearing recesses (68) of the end shaft portions (42). In this way, each of the die carriers (36) is swingable about the axis extending between the two stub shafts (74). Each die carrier (36) is formed along its length with a generally planar die receiving area (76) in FIG. 5, facing outwardly with respect to the rotors (32) and (34). On the reverse side of each die carrier (36), a generally convex profile (78) is formed, the purpose of which is to provide complete rigidity along the length of each die carrier (36), between the two end stub shafts (74).

Reviewing the apparatus so far it will be appreciated that each of the respective upper and lower rotors (32) and (34) will carry two separate die carriers (36), each of which is adapted to receive a forming die (38) thereon. The invention is not however restricted to the use of two die carriers per rotor. Four die carriers have been used in same cases.

The two rotors rotate, in opposite directions, one being clockwise and the other anti-clockwise, being connected by the gears (52) and (56). The dies (38) on the die carriers (36) will thus be brought into registration with one another at approximately the closest point of the two rotors (32) and (34), ie at about 180 degs and 360 degs respectively, and will then progressively move away from one another.

Figure 2:
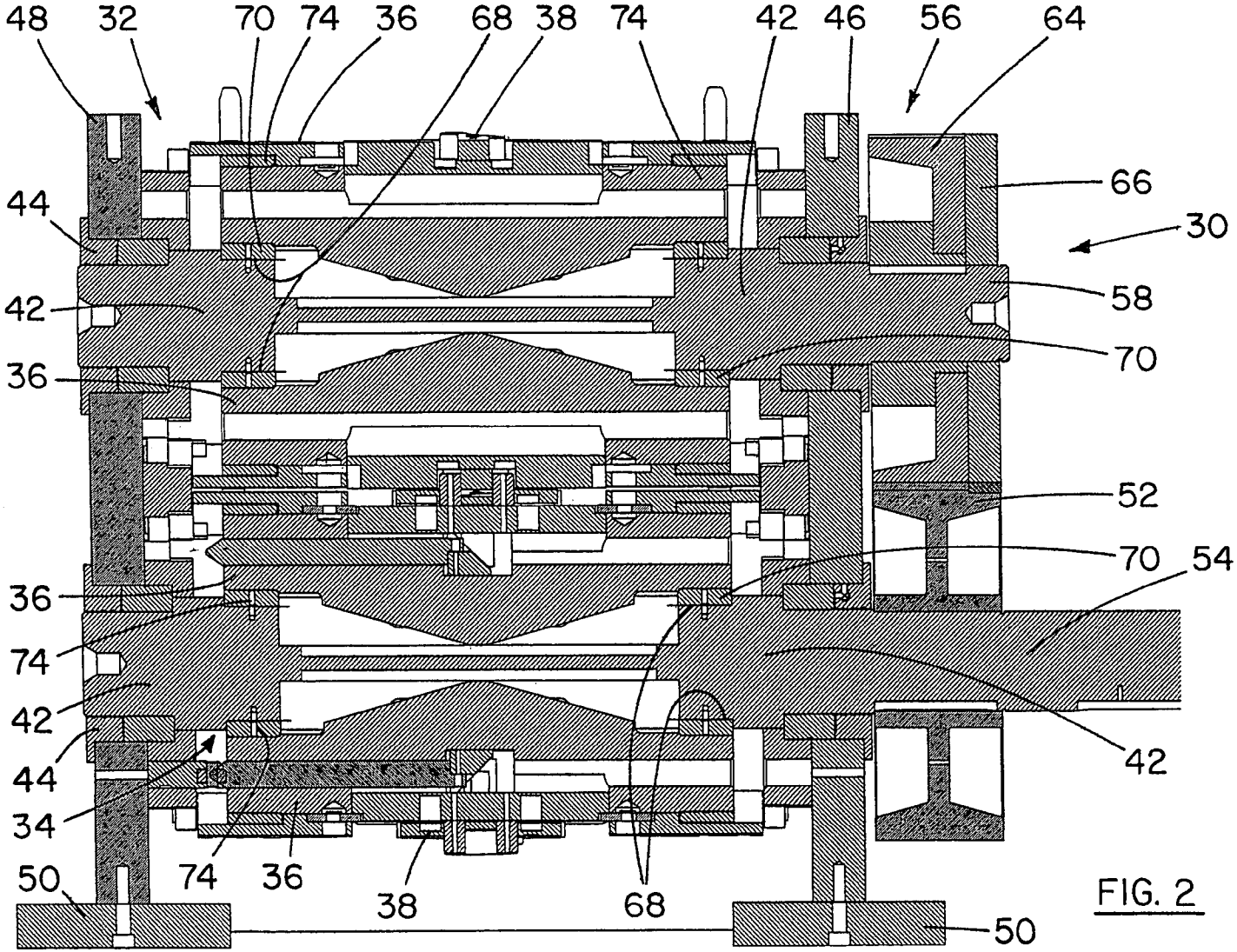
FIG. 2 is a section along line 2-2 of the apparatus of FIG. 1.
Figure 3:
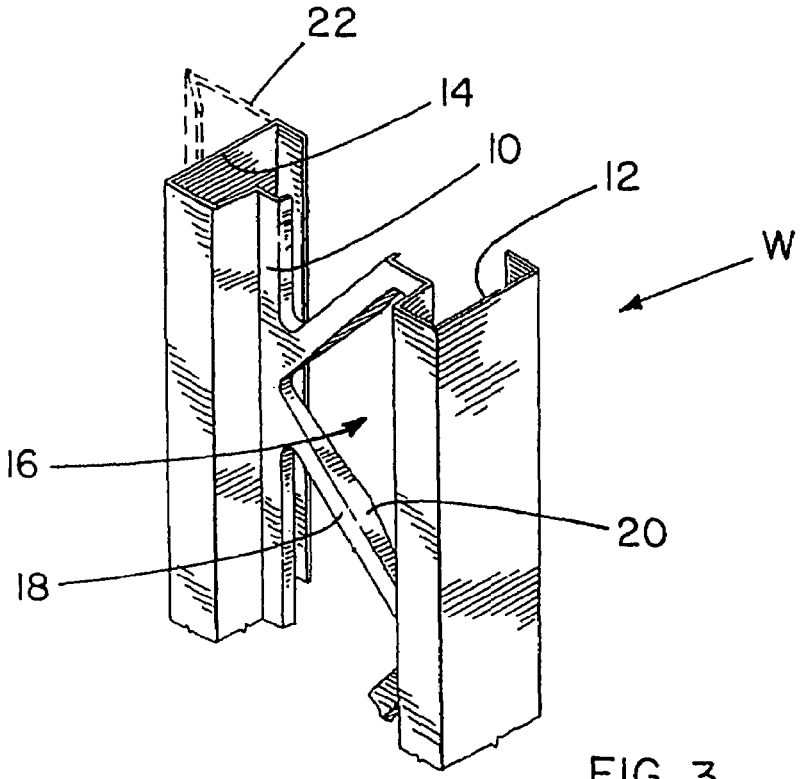
FIG. 3 is a perspective of one form of stud workpiece of the type which may be produced by the apparatus of FIGS. 1 and 2.
Figure 4:
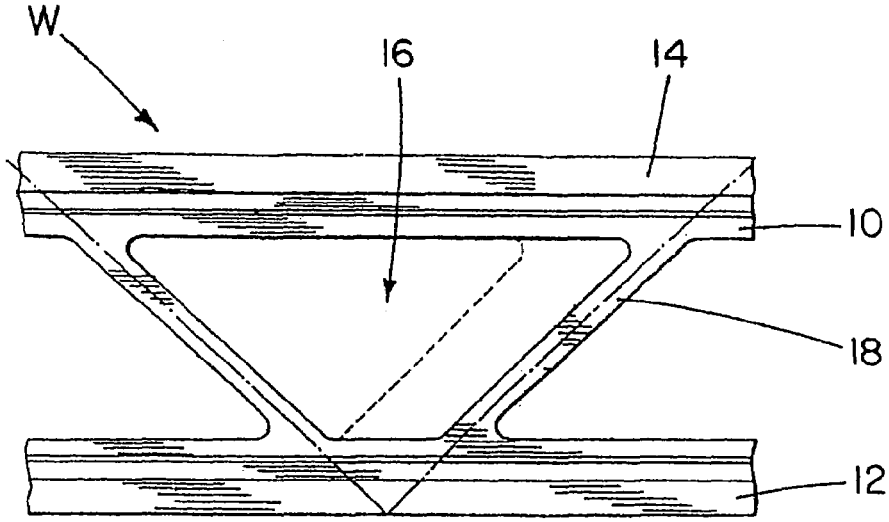
FIG. 4 is a side elevation of FIG. 3.

The die carriers will be farthest away from one another at approximately 90 degs and 270 degs. The dies (38) on the die carriers (36) on the upper rotor (32) will usually be the male dies, and the dies on the lower rotor (34) will usually be female or recess dies. Portions of sheet metal which are actually blanked out of the sheet metal workpiece will form waste or what are known as "slugs", and those slugs will remain temporarily in the recesses of the dies (38) on the lower rotor (34) and will be ejected by suitable slug ejector pins (80) to be described below. Die ejector pins (80) are operated by transverse ejector rods (82) mounted in the lower rotor (34) and having end portions (82) extending outwardly to one end of the lower rotor (34). The inner ends (84) of the rods (82) are formed with an angled surface (86), and when the rods (82) are moved inwardly, the angled surfaces (86) engage the ejector pins (80) and cause them to eject a slug from the die (38). The rod (82) is operated in the reverse direction via springs (not shown) and the ejector pins (80) are also retracted by spring means (not shown). Operation of each of the die ejector rod (82) in sequence is achieved by means of an operating roller (88) mounted on end plate (48) FIG. 2.

The functions of the machine described so far are basically those of which are similar to earlier machines and in this respect they are described here only in general terms. Certain features of the invention will now be described in greater detail.

Die Carrier Guidance

The guidance of the die carriers (36) differs substantially from the guidance systems shown in earlier patents. First cams (90) and second cams (92) are mounted on end plates (46) and (48) adjacent to each end of each of the rotors (32) and (34). First cams (90) are one piece plates formed in a generally oval shape as shown. It will be seen that the second cams (92), FIGS. (12), (13) and FIG. (14), comprises a first generally oval shape centre cam portion (94), and a second semi-arcuate cam portion (96), FIGS. 15, 16 and 17. The oval portion (94) and the semi-arcuate portion (96) define a roller channel (98) between them, and at each end of the space there is what is in effect a "gate" (100) and (102). The function of the gates will be explained below. The first and second cams (90) and (92) and arcuate portions (96) are found on both right and left side bearing plates (46) and (48), arranged as mirror images of each other, and also arranged in registration with both the lower rotor (34) and the upper rotor (32). There are thus, four first cams (90) and four second cam portions (94) and four arcuate portions (96).

Each of the die carriers (36) is provided with leading guide rollers (104) and trailing guide rollers (106), arranged in registration with the leading and trailing edges of their respective die carriers (36), and spaced equally on opposite sides of the central axis of the die carriers stub shaft (40). The leading guide rollers (104) are mounted on shafts (108), which displace the leading guide rollers outwardly with respect to their respective die carriers (36). The trailing guide rollers (106) are mounted on shafts (110), which position the trailing guide rollers (106) more closely adjacent to their die carriers (36), than are the leading guide rollers (104). The displacement of the leading and trailing guide rollers in this way permits the leading and trailing guide rollers to ride on respective first and second cams (90) and (92), and thus follow leading and trailing guide paths which have different profiles from one another, being defined by the respective first and second guide cam (90) and (92). It will be understood that as the rotors (32) and (34) rotate, the die carriers (36) will be rotated around 360 degrees with their respective leading and trailing guide rollers (104) and (106) engaging the respective first and second cams (90) and (92). The guide paths defined by the leading and trailing guide rollers (104) and (106) must necessarily intersect each other twice in each 360 degree revolution. The intersections of these two paths occur at the gates (100) and (102) defined between the second cam plate (94) and the semi-arcuate cam portion (96).

Figure 15:
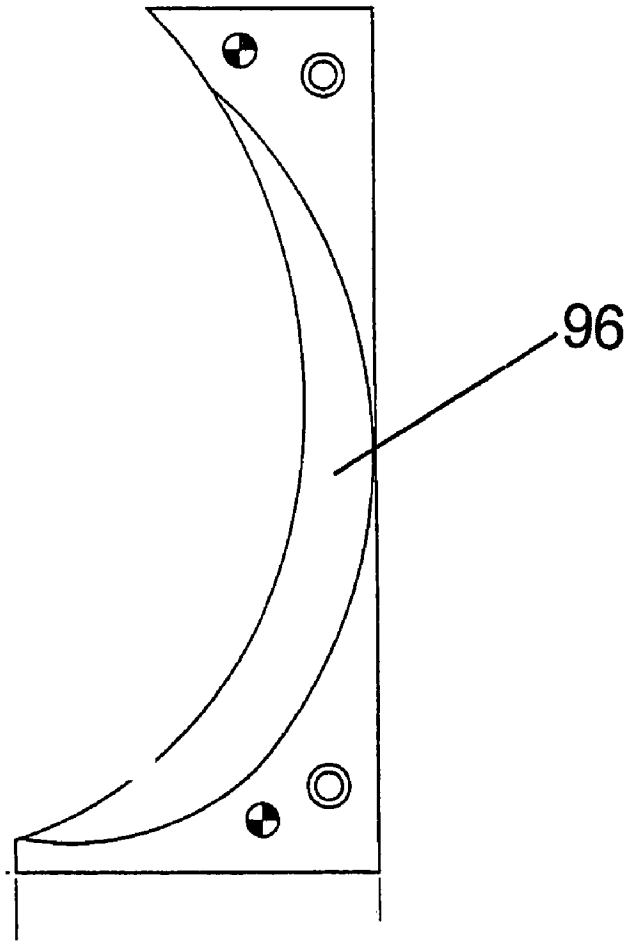
FIG. 15 is an elevational view of semi arcuate cam plate portion of FIG. 14.
Figure 14:
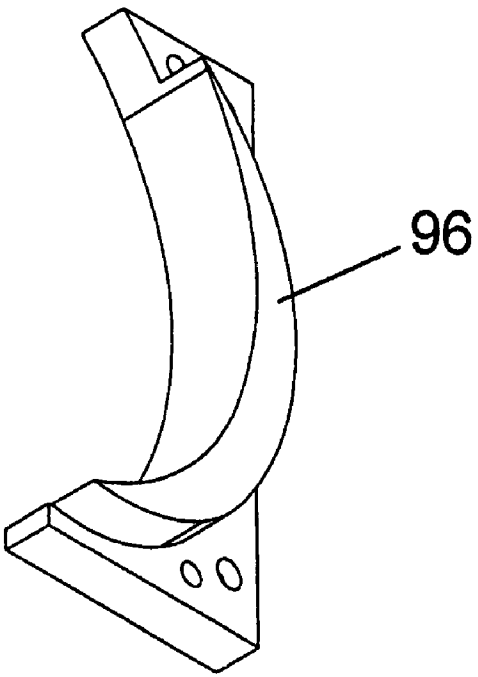
FIG. 14 is perspective illustration of a semi arcuate cam portion.
Figure 16:
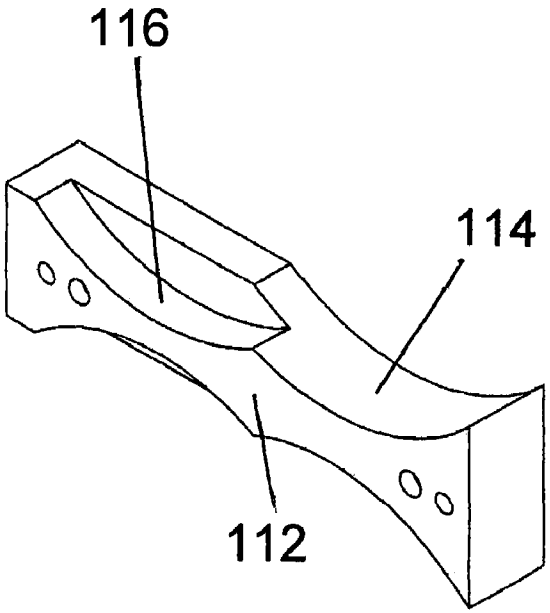
FIG. 16 is a perspective view of a one piece cam guide.
Figure 17:
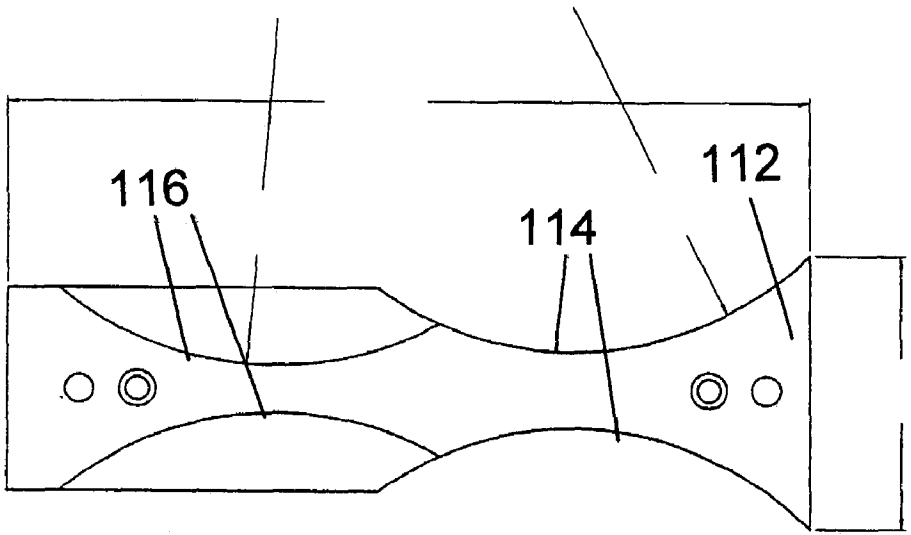
FIG. 17 is a side elevation FIG. 16.
Figure 18:
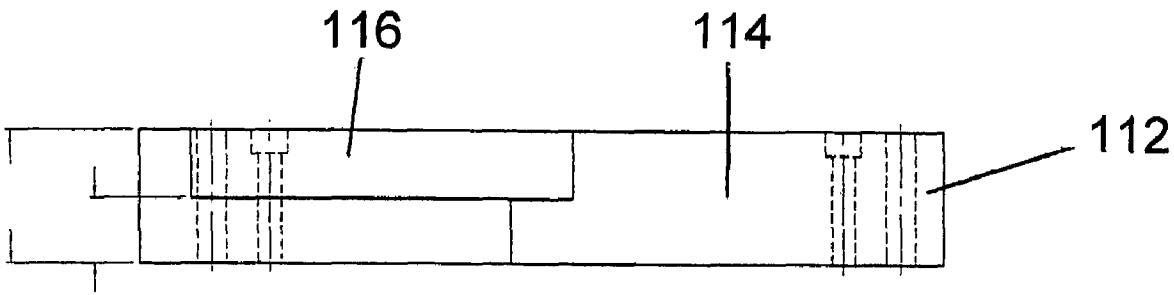
FIG. 18 is a bottom plan view of FIG. 16.
Figure 19:
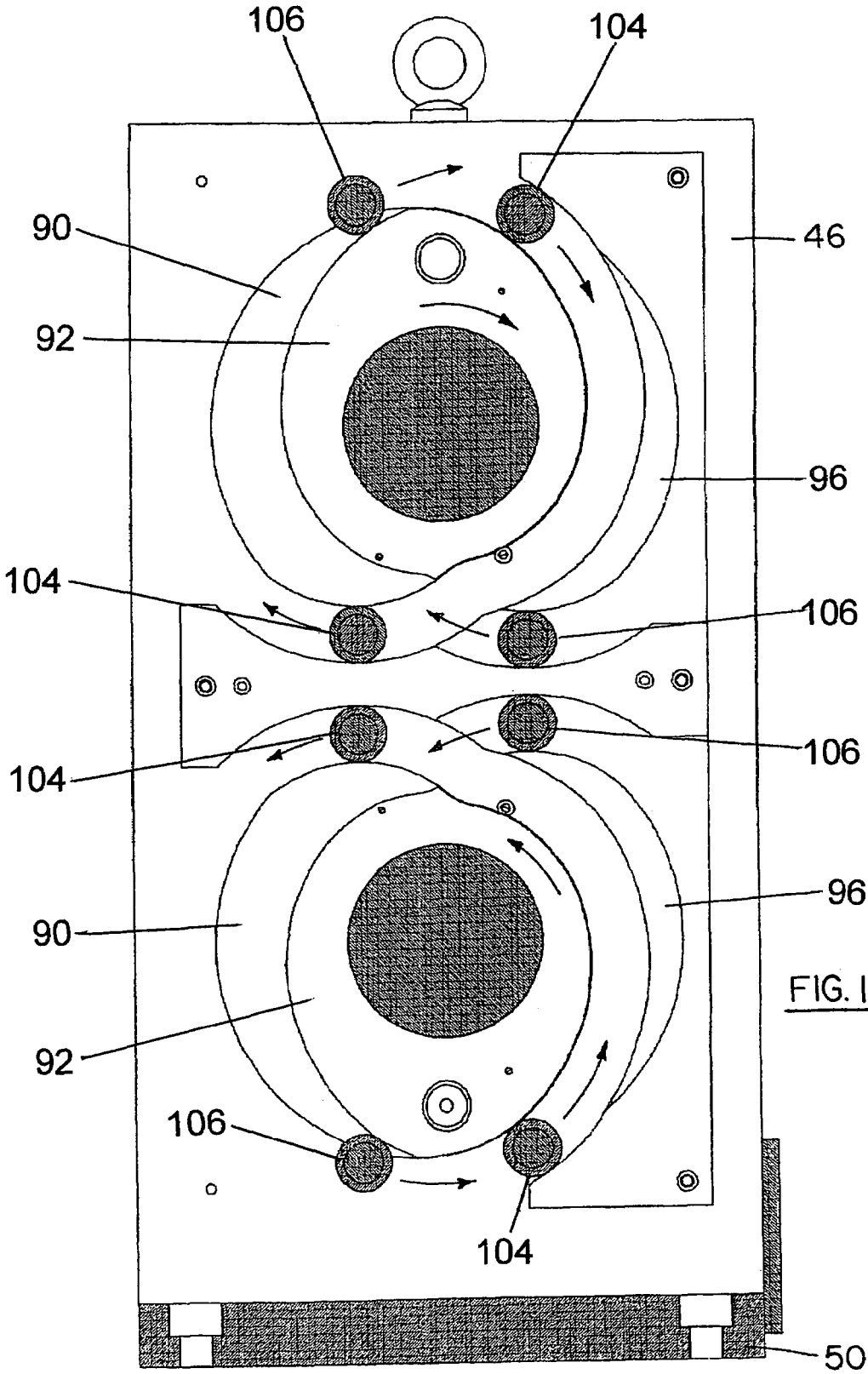
FIG. 19 is a schematic elevation view of the right-hand support plate of FIG. 8; showing the positions of the cam rollers at top and bottom dead centres.
Figure 20:
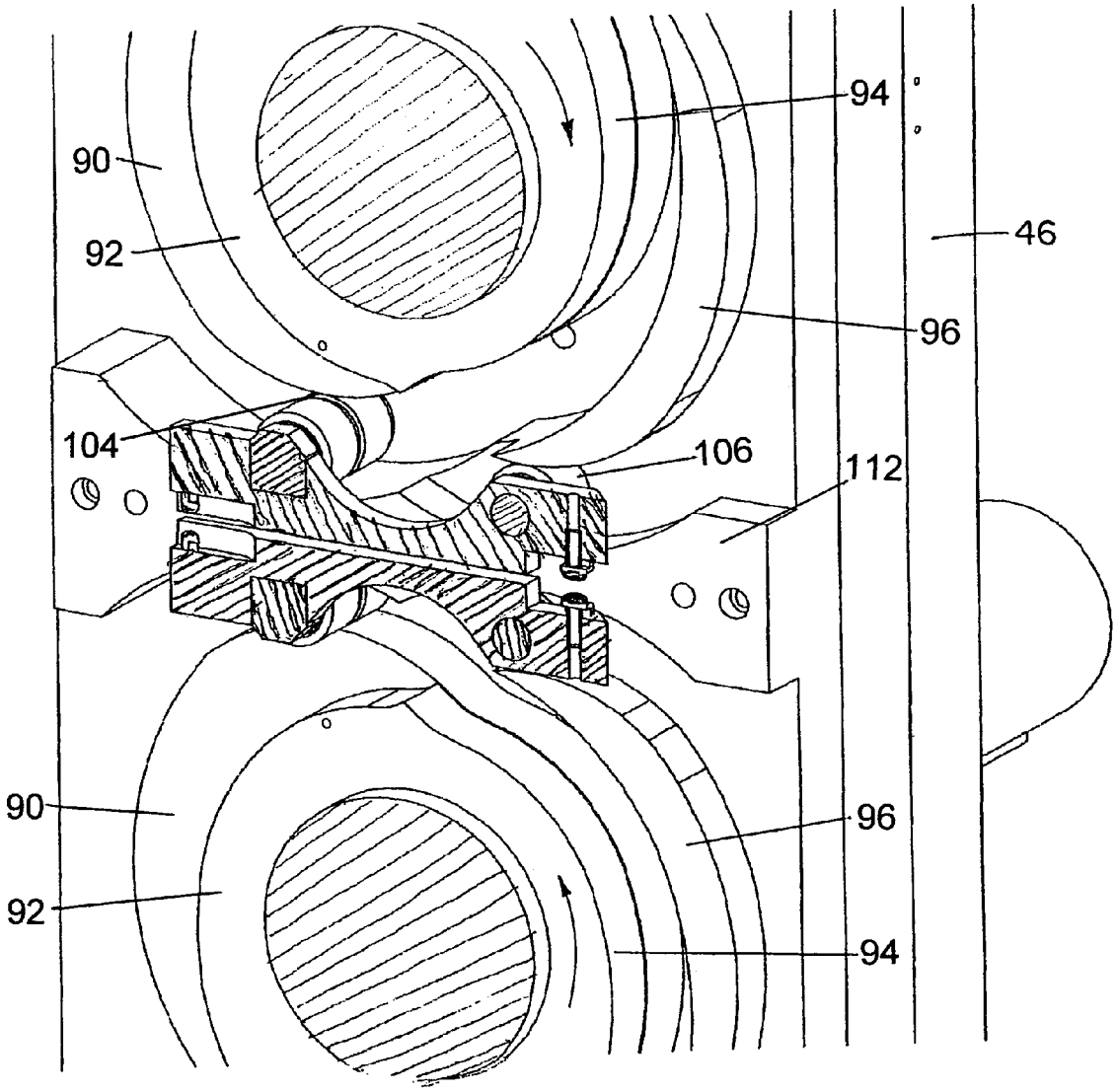
FIG. 20 is a perspective illustration of FIG. 19 showing the cam rollers of the upper and lower rotors at their top dead centre positions.

The semi arcuate cam portions (96) are formed with additional guidance bars (112), for the leading and trailing guide rollers, at the point of closure and openings of the die carriers shown in FIGS. 15, 16 and 17. Such guide bars (112) are formed with two upper and two lower shallow semi-arcuate guide surfaces (114) and (116), which are oriented to engage the leading and trailing guide rollers (104) and (106) respectively from the point just prior to closure, and continue during closure, and to release upon opening. Such guide bars (112) are formed integrally with semi arcuate cam portions (96) and are mounted along side the first and second guide cams (90) and (92) as shown in FIG. (19).

In Operation

In operation, the lower and upper rotors (32) and (34) rotate in opposite directions, as shown for example by arrows in FIG. 1, and a sheet metal workpiece indicated as w passes between them. The sheet metal may be typically fed from an uncoiler, through a flattener or other feed system (not shown) all of which are well known in the roll forming art. As the lower and upper rotors rotate, their respective lower and upper die carriers (36) will be rotated, and in sequence pair of lower and upper die carriers (36) will approach to contact the sheet metal. As they close the dies (38) will punch it and/or form it, and then open again separating away from each side of the sheet metal (W). During the closing and opening of the lower and upper die carriers (36), the linear speeds of the die carriers (36) will vary slightly and will not be precisely matched to the linear speed of the sheet metal which is moving at a constant speed. Just prior to closure on the sheet metal, the die carriers (36) will be moving in a linear manner at a slower speed. At the top and bottom dead centre positions of the rotors (32) and (34) 180 degs and 360 degs, the linear speed of the die carriers will then match the linear speed of the workpiece w. The linear speeds of the carriers (36) will then slow down relative to the workpiece as they open again.

In order to overcome this problem, the motor (60) is controlled through the speed control (62) and the CPU so as to momentarily speed up the rotation of the lower and upper rotors (32) and (34) at a point just prior to closing, and then progressively slow down the rotation of the rotors as the rotors bring the die carriers (36) to bottom and top dead centres, and then the motor once again speeds up the rotors as the die carriers open. The speed control (62) then functions to return to the motor to its regular speed, until the next pair of die carriers (36) is just approaching the closing location. This progressive momentary speed up, followed by a slow down, followed by a speed up, followed by a slow down, takes place according to increments, with the largest increments being at the position of greatest angular displacement of the die carriers relative to 180 degs and 360 degs. However, before closing or during opening, each increment progressively decreases, as the angular displacement of the die carriers (36) progressively decreases from the point before contact, to dead centre and then progressively increases once more from the point of dead centre to the point of opening. The increments of speed variation are represented schematically in the graph of FIG. 24.

In this way, it is possible for the die carriers to move along arcuate paths, at the point just prior to closing and upon opening, in which their linear speed is identical to the linear speed of the sheet metal workpiece.

This control feature, also enables the rotors (32) and (34) to be momentarily stopped, to provide for a gap between the formations in the sheet metal workpiece. This is known as "skipping", and is a particularly useful feature when manufacturing sheet metal construction studs. Such studs must be made in specific lengths as required by the design of the construction on which they are to be used. The top and bottom end of each stud must be such that the metal is unbroken by any formation of indentation or opening at that point. By means of programming CPU, the motor can be momentarily stopped, at a point where for example the die carriers are positioned approximately 90 degs and 180 degs on either side of top and bottom dead centre. At this point, the sheet metal workpiece (W) will be able to pass freely between the rotors (32) and (34). The sheet metal workpieces will normally be cut to desired lengths by a suitable form of shear (not shown) located downstream of the rotor (32) and (34). Such shear may advantageously be mounted on rotors similar to rotors (32) and (34), and may advantageously be operated separate motor means (not shown). The timing and operation of such a shear will take place in timed relation to the "skipping" of openings being formed in the workpiece, and will produce workpieces of the desired lengths.

A further feature of the controllability of the motor controlling the speed of rotation of the rotors (32) and (34) is that it enables variations to be made in the spacing of the centres of the opening and formations formed in the workpiece w. This variation in spacing can be achieved without the necessity for changing over dies on the apparatus. All that is required is to simply reprogram the CPU so as to operate the rotors (32) and (34) at a sufficient speed, between top and bottom dead centres, with brief pauses of greater or of lesser time duration, while the die carriers are at the 90 and 270 deg position.

This will permit more or less of the workpiece to pass between the rotors without the dies contacting the workpiece and making formations. This feature thus enables the production of metal workpieces with formations and openings which are spaced either further apart or closer together along the length of the workpiece, depending upon the requirements of the engineering and construction details for which they are intended.

Alternate Embodiments

Figure 22:
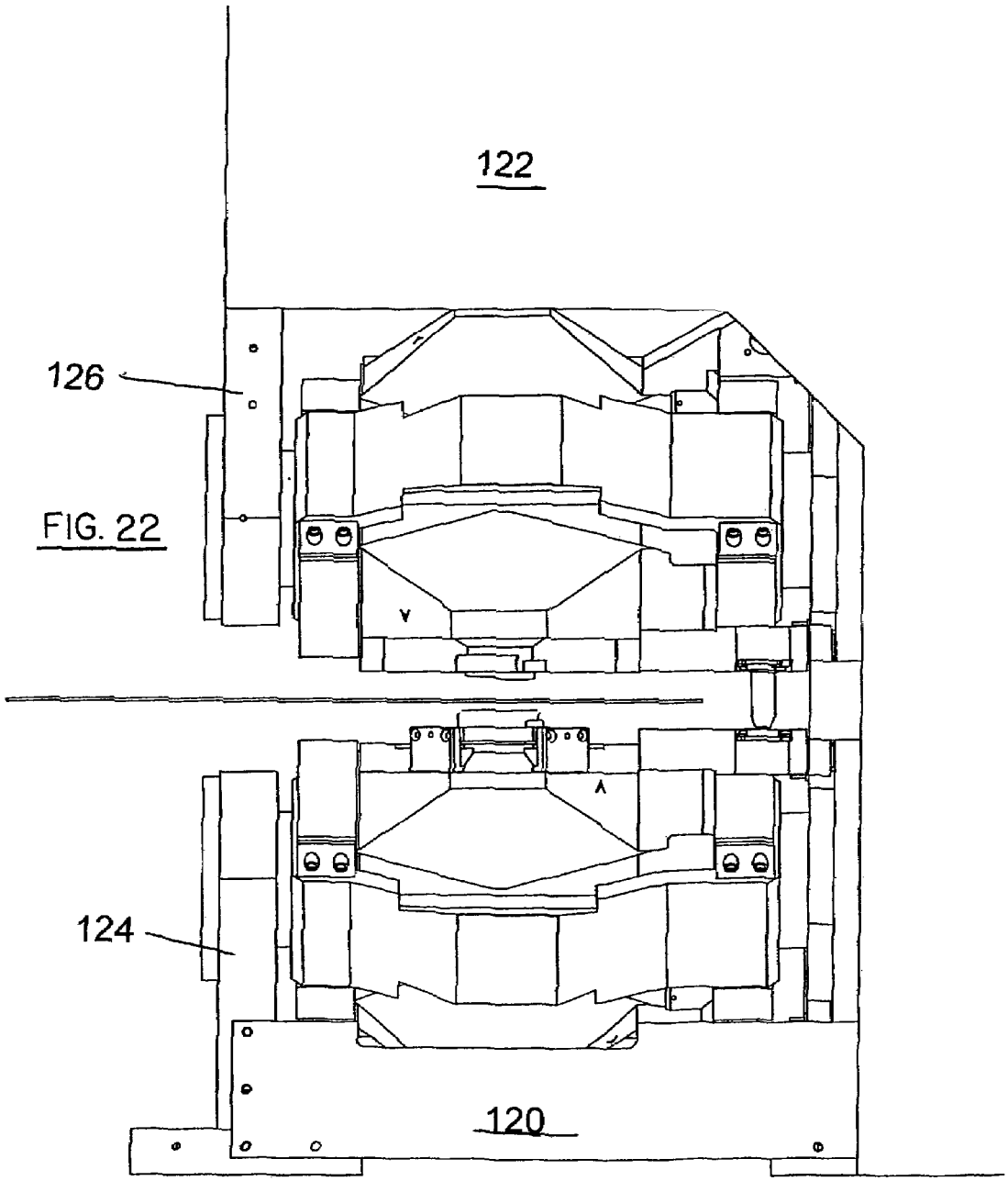
FIG. 22 is a side elevation of the apparatus in FIG. 21.
Figure 23:
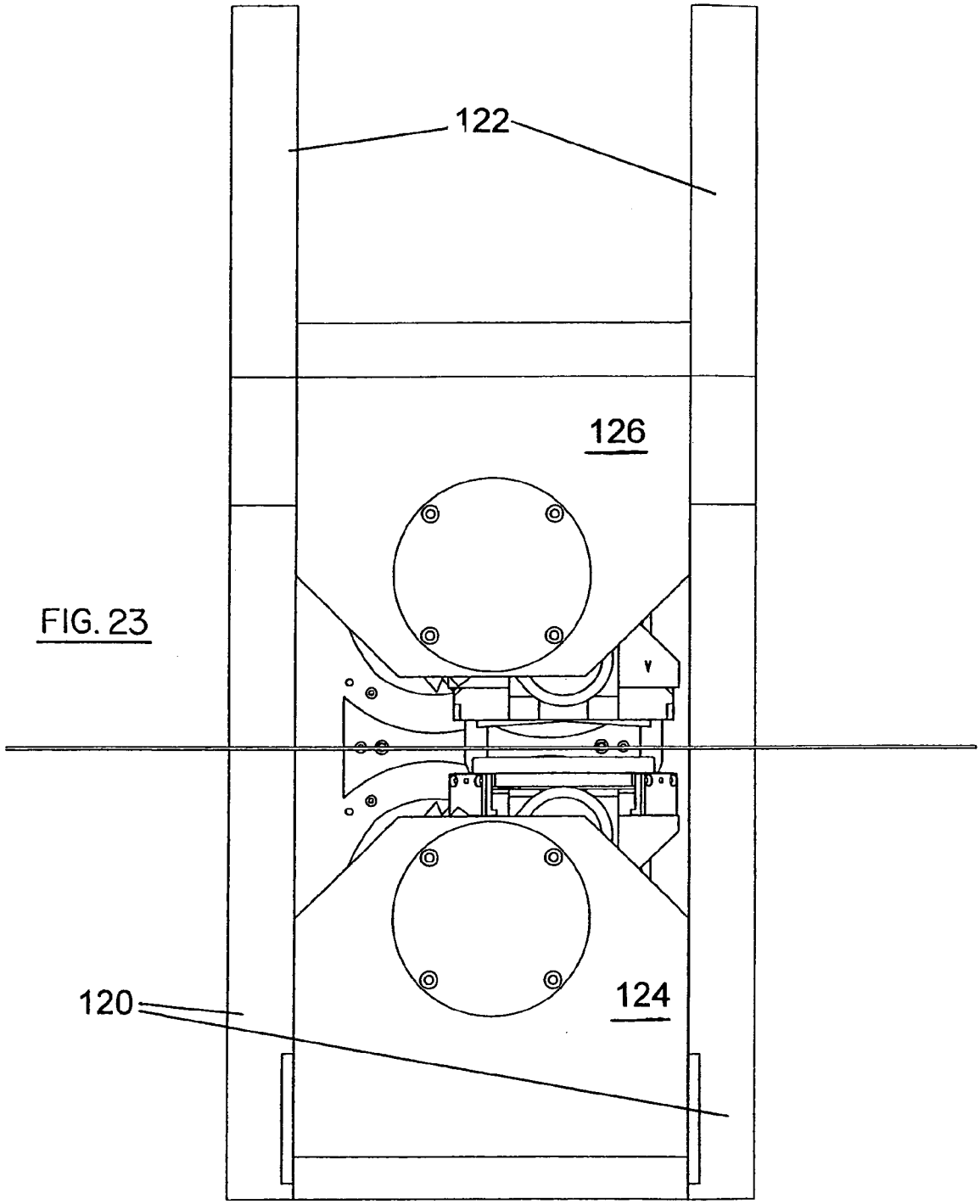
FIG. 23 is an end elevation of the apparatus of FIG. 21.

In some cases, it may be desirable to provide for and open sided rotary apparatus, in which the rotors are supported at one end only, leaving the other end of the rotors unsupported. Such alternate form of rotary apparatus shown in FIGS. 21, 22, and 23. The basic formation of the rotors (32) and (34) and the die carriers (36) all substantially the same as described above, with the exception that the die carriers (36) will be provided with leading and trailing guide rollers, and cams and cam portions only in one end plate The outward ends of the lower and upper rotors (32) and (34) will be supported by massive cross beams (120) and (122), and support arms (124) and (126), providing bearings for the outer end of the rotors (32) and (34).

Figure 21:
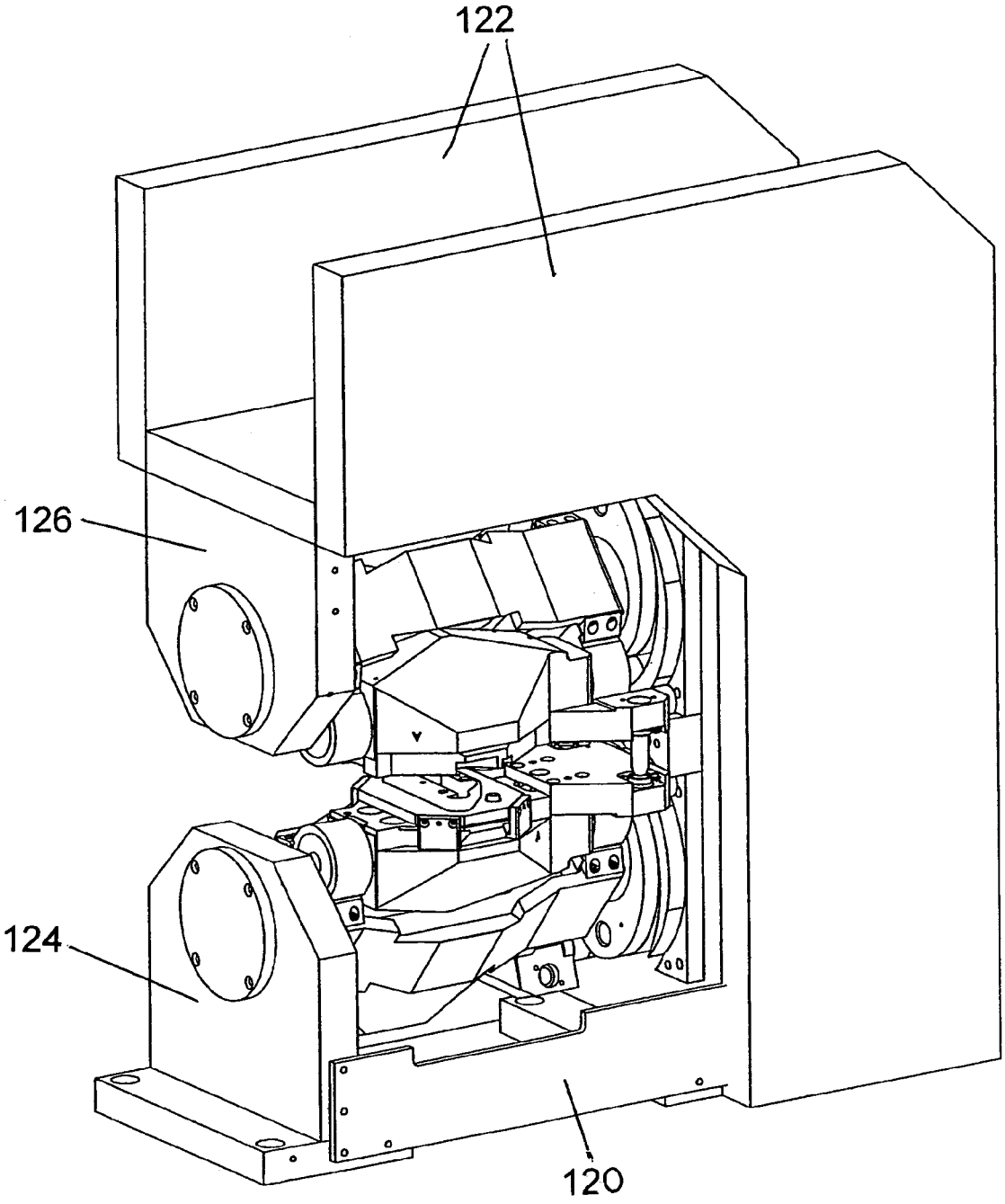
FIG. 21 is a perspective of an alternate embodiment of the apparatus, designed for single sided operation on a sheet metal workpiece.

In this way a metal workpiece (W) may be placed in position through the open side of the apparatus as shown in FIG. 21, and the formations will be made, by the rotors and die carriers and dies in essentially the same manner as described above.

The one edge of the workpiece can extend out between the arms (124) and (126). This provides for great flexibility in use of the apparatus.

In some cases, it may be desirable in order to provide for a different guidance system to achieve a smooth transition from the surface of the second cam (94) and the semi-arcuate cam portion (96). For this variation, FIGS. 25 and 26, a swing arm or bridge (130) may be swingably mounted on each of the semi-arcuate cam portions (96). The bridge (130) is swingable between open and closed positions and guides the leading and trailing guide rollers (104) and (106) as they transition from contact with the semi-arcuate cam portions (96) to the guidance bars (116).

The bridge (130) has a lobe (132) which extends into the path of the trailing guide roller (106). A spring (134) connects between bridge (130) and guide bar (112).

Figure 25:
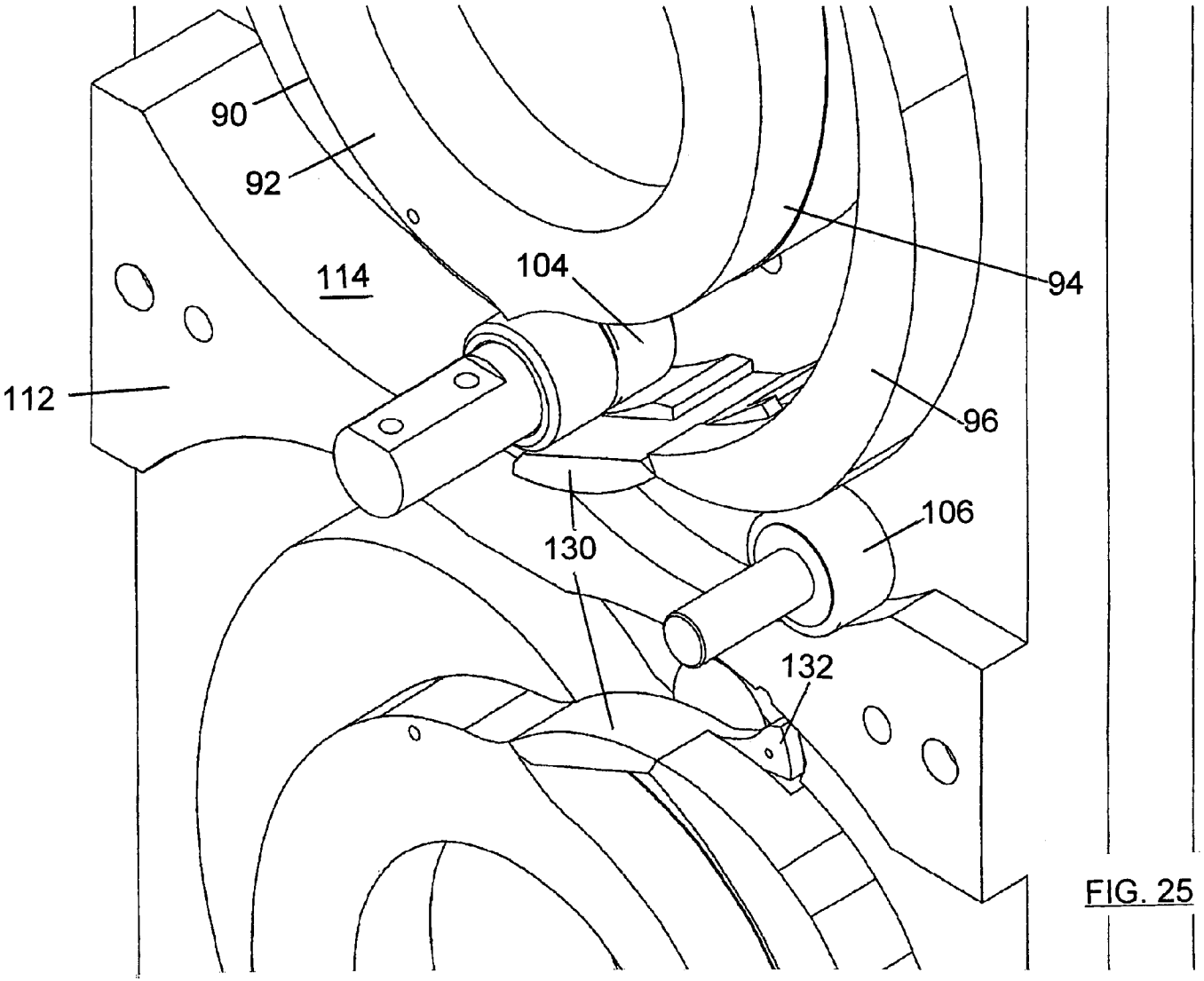
FIG. 25 is a perspective of another embodiment.
Figure 26:
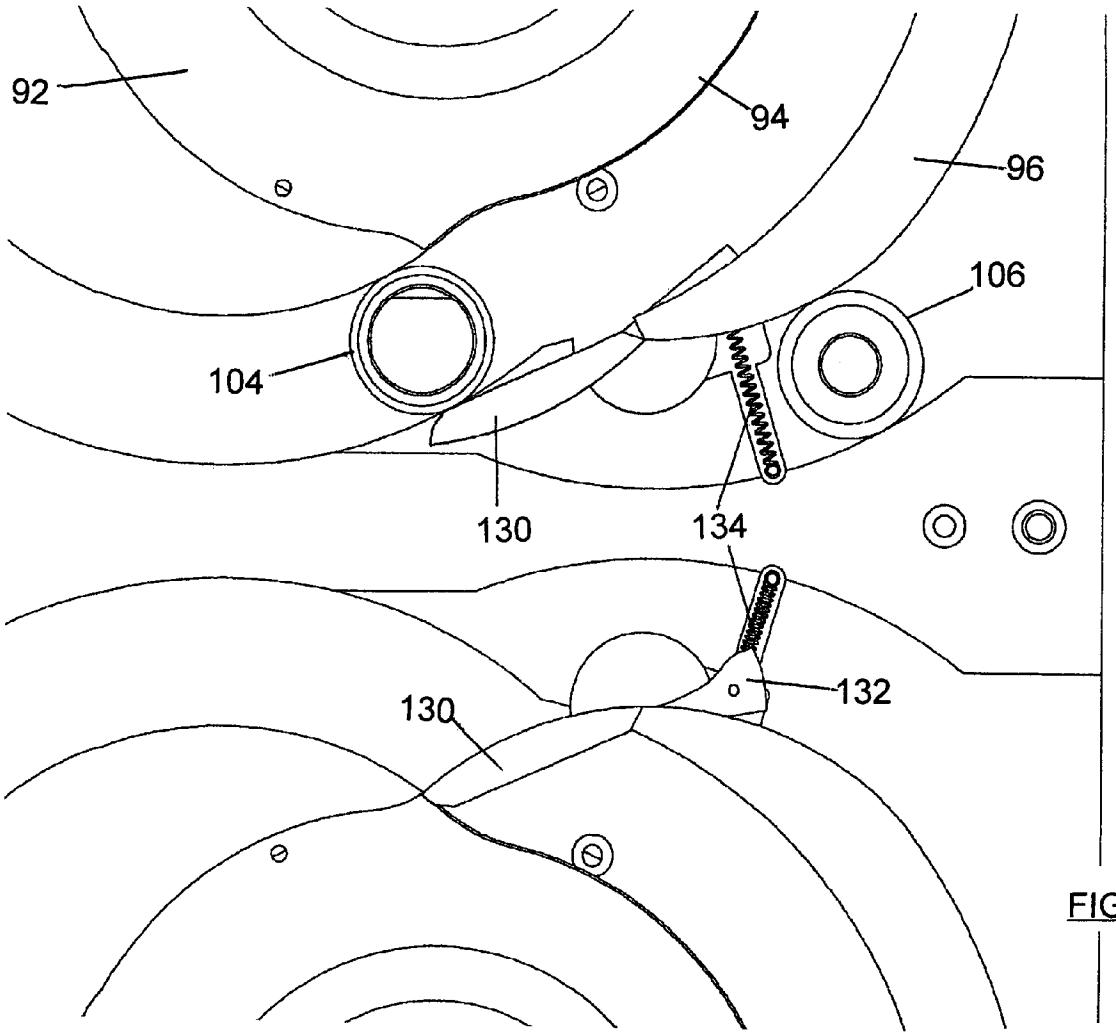
FIG. 26 is a side elevation of FIG. 25.
Figure 27:
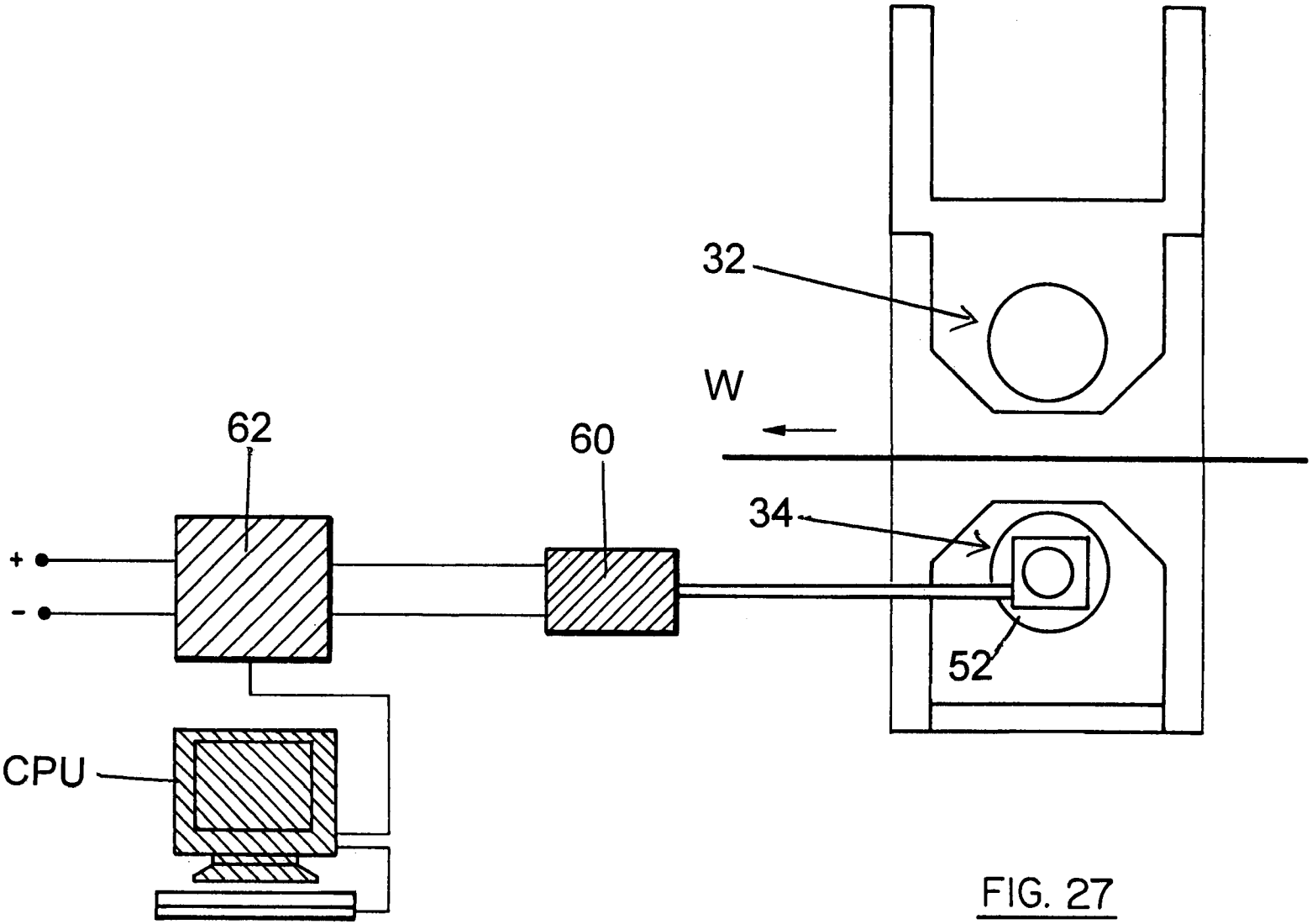
FIG. 27 is a schematic block diagram of the speed controls for speeding up and slowing down the rotors.

FIGS. 25 and 26 show the bridge in two positions, namely open, in the upper bridge, and closed in the lower bridge.

Spring (134) biasses the bridge (130) into the closed (lower) position as shown in FIG. (25), and permits it to swing open (upper) in FIG. 25 when required for either forward, or reverse rotation.

The foregoing is a description of a preferred embodiment of the invention which is given here by way of example only. The invention is not to be taken as limited to any of the specific features as described, but comprehends all such variations thereof as come within the scope of the appended claims.

The invention claimed is:

1. A rotary forming apparatus of the type having a pair of rotors, and one or more die carriers swingably mounted on the rotors, for repeatedly forming a sheet metal work piece moving along a linear path, and comprising;

rotor bearing supports for supporting the rotors at least at one end thereof;

die carriers on said rotors;

die carrier guides on the die carriers at an end thereof adjacent to said rotor bearing supports;

a first integral one piece cam plate adjacent to each said rotor bearing support, at said at least one end, for guiding said die carriers guides;

a second cam plate of at least two part construction adjacent to each said rotor bearing support, at said at least one end, for guiding said die carriers guides;

a gate defined by said second cam plate through which said die carrier guides may pass.

2. A rotary forming apparatus as claimed in claim 1, wherein there are two such rotor bearing supports, one at each end of rotors and wherein said cam plates are mounted on one of said bearing supports, the other of said bearing supports being free of such cam plates.

3. A rotary forming apparatus as claimed in claim 1 wherein the die carriers define leading and trailing edges, and including die carrier guides on at least one said leading edge and one said trailing edge.

4. A rotary forming apparatus as claimed in claim 3 wherein said gates receive said leading edge die carrier guides.

5. A rotary forming apparatus as claimed in claim 3 wherein said leading edge guides are offset outwardly relative to said trailing edge guides.

6. A rotary forming apparatus as claimed in claim 5 wherein said leading edge guides are mounted on shafts, and including rollers rotatably mounted on said shafts between said leading edge guides and said die carriers.

7. A rotary forming apparatus as claimed in claim 1 wherein the rotors are driven by a variable speed motor, and including control means for slowing and speeding up said motor intermittently, in timed relation to the movement of the sheet metal work piece.

8. A rotary forming apparatus as claimed in claim 1 wherein said second cam plate comprises a generally oval shaped cam portion and a semi arcuate cam portion spaced from said oval shaped portion, and a guide channel defined between said oval portion and said semi arcuate portion.

9. A rotary forming apparatus as claimed in claim 8 wherein said semi arcuate portion defines two ends, and wherein said gates are defined between said ends of said semi arcuate portion and said oval shaped portion.

10. A rotary forming apparatus as claimed in claim 9 wherein said semi arcuate portion defines an outer guide surface for contact with said trailing edge guides.

11. A rotary forming apparatus as claimed in claim 10 wherein said semi arcuate portions further comprise guide bar portions for receiving both said leading and trailing edge guides.

12. A rotary forming apparatus as claimed in claim 1 wherein the motor control is operable to speed up the motor at a first predetermined position of said die carriers, and slow down the motor at a second predetermined position of said die carriers, and thereafter speed up the motor at a third predetermined position of said die carriers, and thereafter to slow down said motor.

13. A rotary forming apparatus as claimed in claim 1 wherein there are two such rotors each rotor defining a first end and second end, and a bearing support supporting the first end of each said rotor, the second end of each rotor being unsupported, and the two rotors being mounted for rotation in opposite directions to one another, for engaging a sheet metal work piece passing there between.

14. A rotary forming apparatus as claimed in claim 1 wherein there are a plurality of die carriers and a plurality of such rotors.

* * * * *